US007311525B2

(12) United States Patent
Koiwaya

(10) Patent No.: US 7,311,525 B2
(45) Date of Patent: Dec. 25, 2007

(54) ELECTRICAL CONNECTOR

(75) Inventor: Norio Koiwaya, Machida (JP)

(73) Assignee: I-PEX Co., Ltd., Tokyo (JP)

( * ) Notice: Subject to any disclaimer, the term of this patent is extended or adjusted under 35 U.S.C. 154(b) by 0 days.

(21) Appl. No.: 11/648,631

(22) Filed: Jan. 3, 2007

(65) Prior Publication Data

US 2007/0254496 A1 Nov. 1, 2007

(30) Foreign Application Priority Data

Apr. 28, 2006 (JP) ..... 2006-126792

(51) Int. Cl.
*H01R 39/00* (2006.01)

(52) U.S. Cl. ..... 439/31; 439/131

(58) Field of Classification Search ..... 439/31, 439/131, 534, 713, 347, 567, 608–610
See application file for complete search history.

(56) References Cited

U.S. PATENT DOCUMENTS 6,142,834 A * 11/2000 Liao ..... 439/676
6,364,672 B1 * 4/2002 Miyazoe et al. ..... 439/131
6,397,078 B1 * 5/2002 Kim ..... 455/556.2
7,146,197 B2 * 12/2006 Kang et al. ..... 455/575.1
7,158,817 B2 * 1/2007 Kubo ..... 455/575.3
7,172,428 B2 * 2/2007 Huang ..... 439/11

FOREIGN PATENT DOCUMENTS

JP 2006-059788 3/2006

* cited by examiner

*Primary Examiner*—J. F. Duverne
(74) *Attorney, Agent, or Firm*—Nixon Peabody LLP; Donald R. Studebaker

(57) ABSTRACT

An electrical connector comprising a fixed housing attached to a circuit board, a movable housing provided with a connecting hollow in which a counterpart electrical connector is inserted, conductive contacts for coupling the movable housing with the fixed housing and having a portion connected with a circuit terminal on the circuit board, and an engaging mechanism operative to put the movable housing selectively in a first state in which the movable housing is temporarily fixed to the fixed housing and takes a first posture with which an inserting direction of the counterpart electrical connector to the connecting hollow is angled to the circuit board and in a second state in which the movable housing is able to move freely to the fixed housing in a predetermined range and takes a second posture with which the inserting direction of the counterpart electrical connector to the connecting hollow is in substantially parallel with the circuit board.

16 Claims, 35 Drawing Sheets

ELECTRICAL CONNECTOR

BACKGROUND OF THE INVENTION

1. Field of the Invention

The present invention relates generally to an electrical connector, and more particularly to an improvement in an electrical connector comprising a fixed housing which is attached to a circuit board and a movable housing which is coupled through conductive contacts with the fixed housing and provided with a connecting hollow in which a counterpart electrical connector is inserted to be electrically connected with the conductive contacts.

2. Description of the Prior Art

In the case where, for example, a relatively small-sized hard disc drive conformity with the SATA (Serial AT Attachment) which is one of extensions of the ATA (AT Attachment) standard is electrically connected with a solid printed circuit board, on which various electrical parts are directly mounted, an electrical connector having a floating coupling portion which is able to move in a predetermined range to be coupled with the hard disc drive is used. The electrical connector having the floating coupling portion comprises a fixed housing attached to the solid printed circuit board and a movable housing coupled through conductive contacts with the fixed housing. A connecting hollow in which a counterpart electrical connector provided on the hard disc drive is inserted to be connected with the conductive contacts is provided in the movable housing to form the floating coupling portion with which the hard disc drive is coupled.

In such an electrical connector as mentioned above, vibrations and shocks acting on the hard disc drive coupled with the floating coupling portion are absorbed by the movable housing in which the floating coupling portion is provided. Therefore, the hard disc drive coupled with the floating coupling portion is protected against the vibrations and shocks acting thereon.

There has been previously proposed, as the electrical connector having the floating coupling portion, an electrical connector in which a movable housing provided with a coupling hollow forming a floating coupling portion is arranged to be able to move to a fixed housing attached to a circuit board in a predetermined range in its posture with which a counterpart electrical connector is inserted in the connecting hollow along a direction in parallel with the circuit board, as shown in, for example, the Japanese patent application published before examination under publication number 2006-59788 (Published document 1).

In the electrical connector having the floating coupling portion as shown in the published document 1, the movable housing provided therein with the coupling hollow is always kept in the posture with which the counterpart electrical connector is inserted in the connecting hollow along the direction in parallel with the circuit board to which the fixed housing is attached. The movable housing thus postured can move to the fixed housing in each of a first direction in parallel with the direction along which the counterpart electrical connector is inserted in the connecting hollow and second and third directions each perpendicular to the first direction.

When the counterpart electrical connector is not inserted in the connecting hollow provided in the movable housing, the movable housing is put in a first state in which the movable housing engages with the fixed housing to be temporary fixed to the same in the first direction. On the other hand, after the counterpart electrical connector has been inserted in the connecting hollow provided in the movable housing, the movable housing is automatically released from the first state so as to be put in a second state in which the movable housing is movable to the fixed housing in each of the first, second and third directions.

The above means that the counterpart electrical connector is inserted in the connecting hollow provided in the movable housing along the direction parallel with the circuit board to which the fixed housing is attached when the movable housing is put in the first state to be temporary fixed to the fixed housing in the first direction and then the movable housing accompanied with the counterpart electrical connector is released from the first state, without changing the posture thereof, so as to be put in the second state to be movable to the fixed housing in each of the first, second and third directions.

For such operations, a locking mechanism is provided to be related with both the fixed and movable housings for putting the movable housing in the first state and the second state selectively.

In the electrical connector having the floating coupling portion thus proposed previously, when the counterpart electrical connector is inserted in the connecting hollow provided in the movable housing, the movable housing is temporarily fixed to the fixed housing in the first direction and movable to the fixed housing in the second and third directions. Therefore, there is a problem that the connecting hollow provided in the movable housing is likely to shift its position in the second and third directions when the counterpart electrical connector is intended to be inserted in the connecting hollow provided in the movable housing so that the insertion of the counterpart electrical connector in the connecting hollow is not easy to be surely done.

Further, since the direction along which the counterpart electrical connector is inserted in the hollow provided in the movable housing is set to be in parallel with the circuit board to which the fixed housing is attached, it is necessary to move the counterpart electrical connector to the connecting hollow provided in the movable housing in parallel with the circuit board to which the fixed housing is attached in order to insert the counterpart electrical connector in the connecting hollow. This brings about another problem that it is not easy to move the counterpart electrical connector to the connecting hollow in parallel with the circuit board because the connecting hollow provided in the movable housing is usually positioned to be close to the circuit board to which the fixed housing is attached so that a space between the connecting hollow and the circuit board is relatively small and, in addition, various circuit parts are mounted on the circuit board in the vicinity of the connecting hollow.

Besides, the previously proposed electrical connector having the floating coupling portion comprises a large number of mechanical parts and is provided with a complicated mechanism for fixing the movable housing to the fixed housing in the first direction. This results in a disadvantage that the previously proposed electrical connector is inferior in its assembling easiness in production facilities.

OBJECTS AND SUMMARY OF THE INVENTION

Accordingly, it is an object of the present invention to provide an electrical connector comprising a fixed housing attached to a circuit board and a movable housing coupled through conductive contacts with the fixed housing and provided with a connecting hollow in which a counterpart electrical connector is inserted to be electrically connected with the conductive contacts, which avoids the aforementioned problems or disadvantages encountered with the prior art.

Another object of the present invention is to provide an electrical connector comprising a fixed housing attached to a circuit board and a movable housing coupled through conductive contacts with the fixed housing and provided with a connecting hollow in which a counterpart electrical connector is inserted to be electrically connected with the conductive contacts, with which the counterpart electrical connector can be easily and surely inserted in the connecting hollow provided in the movable housing with simple and easy operations.

A further object of the present invention is to provide an electrical connector comprising a fixed housing attached to a circuit board and a movable housing coupled through conductive contacts with the fixed housing and provided with a connecting hollow in which a counterpart electrical connector is inserted to be electrically connected with the conductive contacts, in which the counterpart electrical connector can be easily and surely inserted in the connecting hollow provided in the movable housing and the movable housing accompanied with the counterpart electrical contact can be put in a second state in which the counterpart electrical contact moves freely to the fixed housing in a predetermined range.

A still further object of the present invention is to provide an electrical connector comprising a fixed housing attached to a circuit board and a movable housing coupled through conductive contacts with the fixed housing and provided with a connecting hollow in which a counterpart electrical connector is inserted to be electrically connected with the conductive contacts, which can be assembled with relatively simple structure with easy assembling operations in production facilities.

According to the present invention, as claimed in any one of claims, there is provided an electrical connector, which comprises a fixed housing attached to a circuit board, a movable housing provided with a connecting hollow in which a counterpart electrical connector is inserted, a plurality of conductive contacts which are arranged in a predetermined direction for coupling the movable housing with the fixed housing and each of which has a portion connected with a circuit terminal on the circuit board to which the fixed housing is attached and another portion positioned in the connecting follow for coming into press-contact with a connecting terminal provided on the counterpart electrical connector inserted in the connecting hollow, and an engaging mechanism including parts of the fixed and movable housings and operative to put the movable housing selectively in a first state in which the movable housing is temporarily fixed to the fixed housing and takes a first posture with which an inserting direction of the counterpart electrical connector to the connecting hollow is angled to the circuit board to which the fixed housing is attached and in a second state in which the movable housing is able to move freely to the fixed housing in a predetermined range and takes a second posture with which the inserting direction of the counterpart electrical connector to the connecting hollow is in substantially parallel with the circuit board to which the fixed housing is attached.

Especially, in a first embodiment of electrical connector according to the present invention, each of the conductive contacts is made of conductive resilient material for forcing the movable housing to keep away from the fixed housing.

In a second embodiment of electrical connector according to the present invention, the engaging mechanism is operative to allow the movable housing to rotate to the fixed housing so that the inserting direction of the counterpart electrical connector to the connecting hollow varies in its angle to the circuit board to which the fixed housing is attached.

In a third embodiment of electrical connector according to the present invention, the engaging mechanism comprises a slit provided on an end of the fixed housing for interconnecting a guiding hole having an engaging cutout portion with to the outside of the fixed housing and an engaging projection provided on an end of the movable housing for moving from the outside of the fixed housing through the slit into the guiding hole and engaging with the engaging cutout portion, and the engaging cutout portion and the engaging objections constitutes a locking mechanism for putting the movable housing in the first state in which the movable housing is temporarily fixed to the fixed housing and takes the first posture with which the inserting direction of the counterpart electrical connector to the connecting hollow is angled to the circuit board to which the fixed housing is attached.

In the electrical connector thus constituted in accordance with the present invention, the movable housing is caused by the engaging mechanism to be put selectively in the first state in which the movable housing is temporarily fixed to the fixed housing and takes the first posture with which the inserting direction of the counterpart electrical connector to the connecting hollow is angled to the circuit board to which the fixed housing is attached and in the second state in which the movable housing is able to move freely to the fixed housing in the predetermined range and takes the second posture with which the inserting direction of the counterpart electrical connector to the connecting hollow is in substantially parallel with the circuit board to which the fixed housing is attached. Then, when the movable housing is put in the first state in which the movable housing is temporarily fixed to the fixed housing and takes the first posture with which the inserting direction of the counterpart electrical connector to the connecting hollow is angled to the circuit board to which the fixed housing is attached, the counterpart electrical connector is inserted in the connecting hollow provided in the movable housing. After that, the movable housing is put in the second state in which the movable housing accompanied with the counterpart electrical connector is able to move freely to the fixed housing in the predetermined range and takes the second posture with which the inserting direction of the counterpart electrical connector to the connecting hollow is in substantially parallel with the circuit board to which the fixed housing is attached.

The counterpart electrical connector inserted in the connecting hollow provided in the movable housing is electrically connected through the conductive contacts with the circuit board to which the fixed housing is attached.

In one of embodiments of electrical connector according to the present invention, the locking mechanism for putting the movable housing in the first state in which the movable housing is temporarily fixed to the fixed housing and takes the first posture with which the inserting direction of the counterpart electrical connector to the connecting hollow is angled to the circuit board to which the fixed housing is attached, is constituted with the engaging cutout portion formed on a part of the guiding hole provided on the fixed housing and the engaging objections provided on the movable housing for engaging with the engaging cutout portion.

With the electrical connector according to the present invention, it is possible to insert the counterpart electrical connector in the connecting hollow provided in the movable housing which is put in the first state in which the movable housing is temporarily fixed to the fixed housing and takes the first posture with which the inserting direction of the counterpart electrical connector to the connecting hollow is angled to the circuit board to which the fixed housing is attached. Therefore, the counterpart electrical connector can be easily and surely inserted in the connecting hollow provided in the movable housing with simple and easy operations.

After the counterpart electrical connector has been inserted in the connecting hollow provided in the movable housing, it is possible to put the movable housing in the second state in which the movable housing accompanied with the counterpart electrical connector is able to move freely to the fixed housing in the predetermined range and takes the second posture with which the inserting direction of the counterpart electrical connector to the connecting hollow is in substantially parallel with the circuit board to which the fixed housing is attached. Therefore, vibrations and shocks acting on an apparatus or device on which the counterpart electrical connector is provided are absorbed by the movable housing so that the apparatus or device on which the counterpart electrical connector is provided is protected against the vibrations and shocks acting thereon.

Especially, with the first embodiment of electrical connector according to the present invention, since each of the conductive contacts is made of conductive resilient material for forcing the movable housing to keep away from the fixed housing, it is very easy to put the movable housing in either of the first state in which the movable housing is temporarily fixed to the fixed housing and takes the first posture with which the inserting direction of the counterpart electrical connector to the connecting hollow is angled to the circuit board to which the fixed housing is attached and the second state in which the movable housing is able to move freely to the fixed housing in the predetermined range and takes the second posture with which the inserting direction of the counterpart electrical connector to the connecting hollow is in substantially parallel with the circuit board to which the fixed housing is attached.

With the second embodiment of electrical connector according to the present invention, since the engaging mechanism is operative to allow the movable housing to rotate to the fixed housing so that the inserting direction of the counterpart electrical connector to the connecting hollow varies in its angle to the circuit board, it is very easy, similarly to the first embodiment, to put the movable housing in either of the first state in which the movable housing is temporarily fixed to the fixed housing and takes the first posture with which the inserting direction of the counterpart electrical connector to the connecting hollow is angled to the circuit board to which the fixed housing is attached and the second state in which the movable housing is able to move freely to the fixed housing in the predetermined range and takes the second posture with which the inserting direction of the counterpart electrical connector to the connecting hollow is in substantially parallel with the circuit board to which the fixed housing is attached.

Further, since the engaging projection provided on the movable housing is operative to move from the outside of the fixed housing through the slit provided on the fixed housing into the guiding hole provided also on the fixed housing and engaging with the engaging cutout portion formed on the part of the guiding hole in the third embodiment of electrical connector according to the present invention, the third embodiment can be assembled with relatively simple structure with easy assembling operations in production facilities.

The above, and other objects, features and advantages of the present invention will become apparent from the following detailed description taken in conjunction with the accompanying drawings.

DESCRIPTION OF THE PREFERRED EMBODIMENTS

Figure 1:
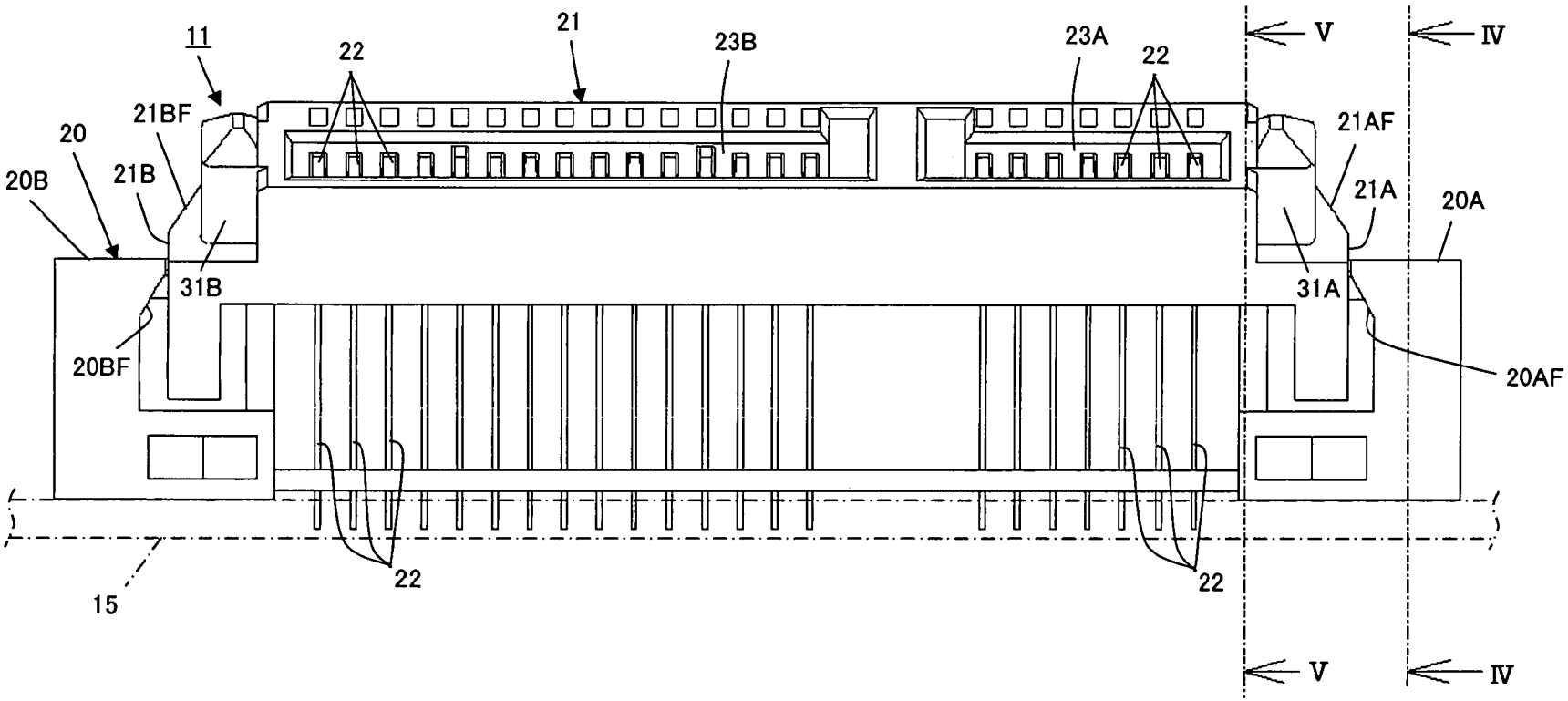
FIG. 1 is a schematic front view showing an embodiment of electrical connector according to the present invention.
Figure 2:
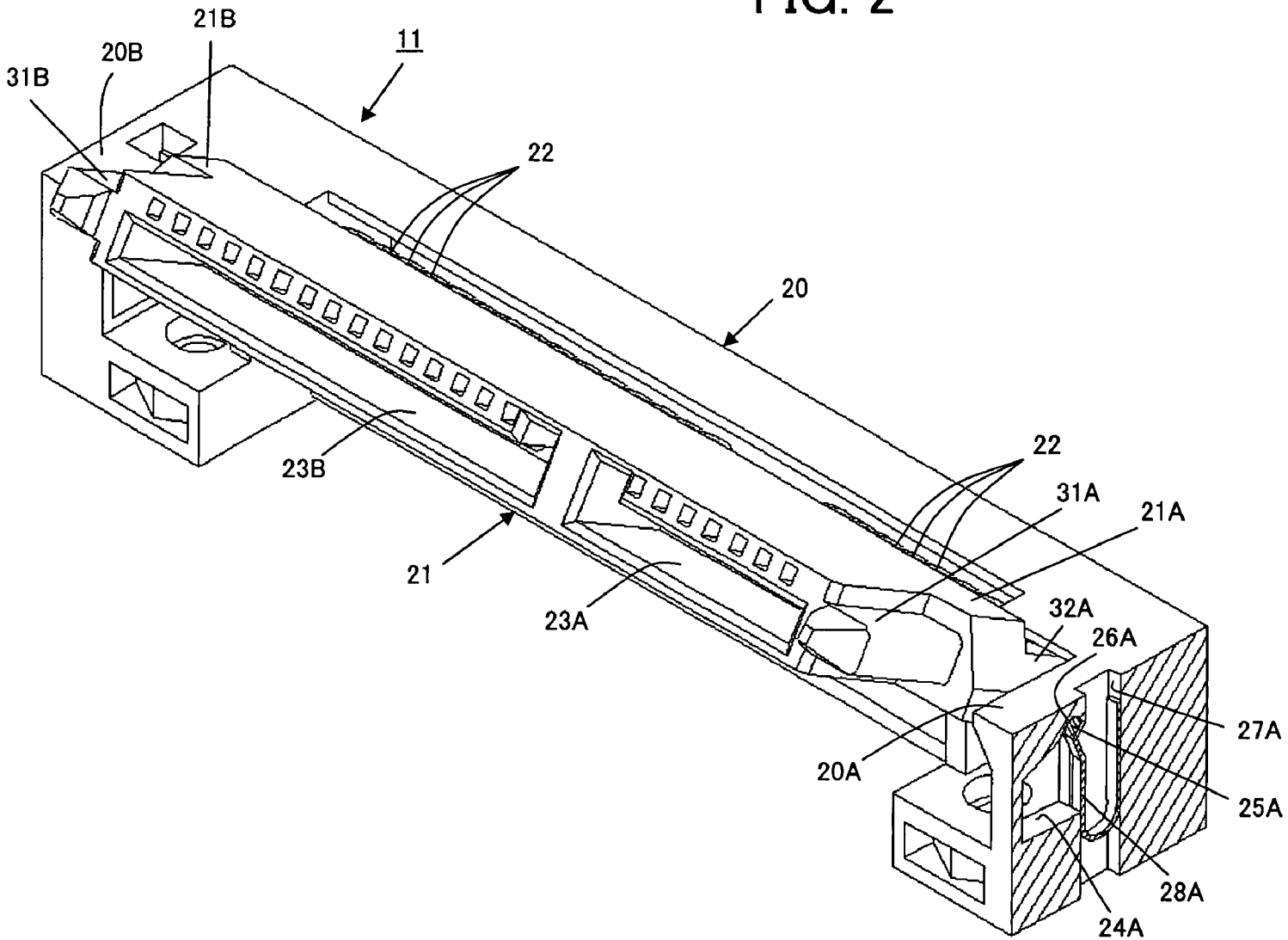
FIG. 2 is a schematic perspective view showing the embodiment shown in FIG. 1, a part of which on the right of line IV-IV in FIG. 1 is cut out.
Figure 3:
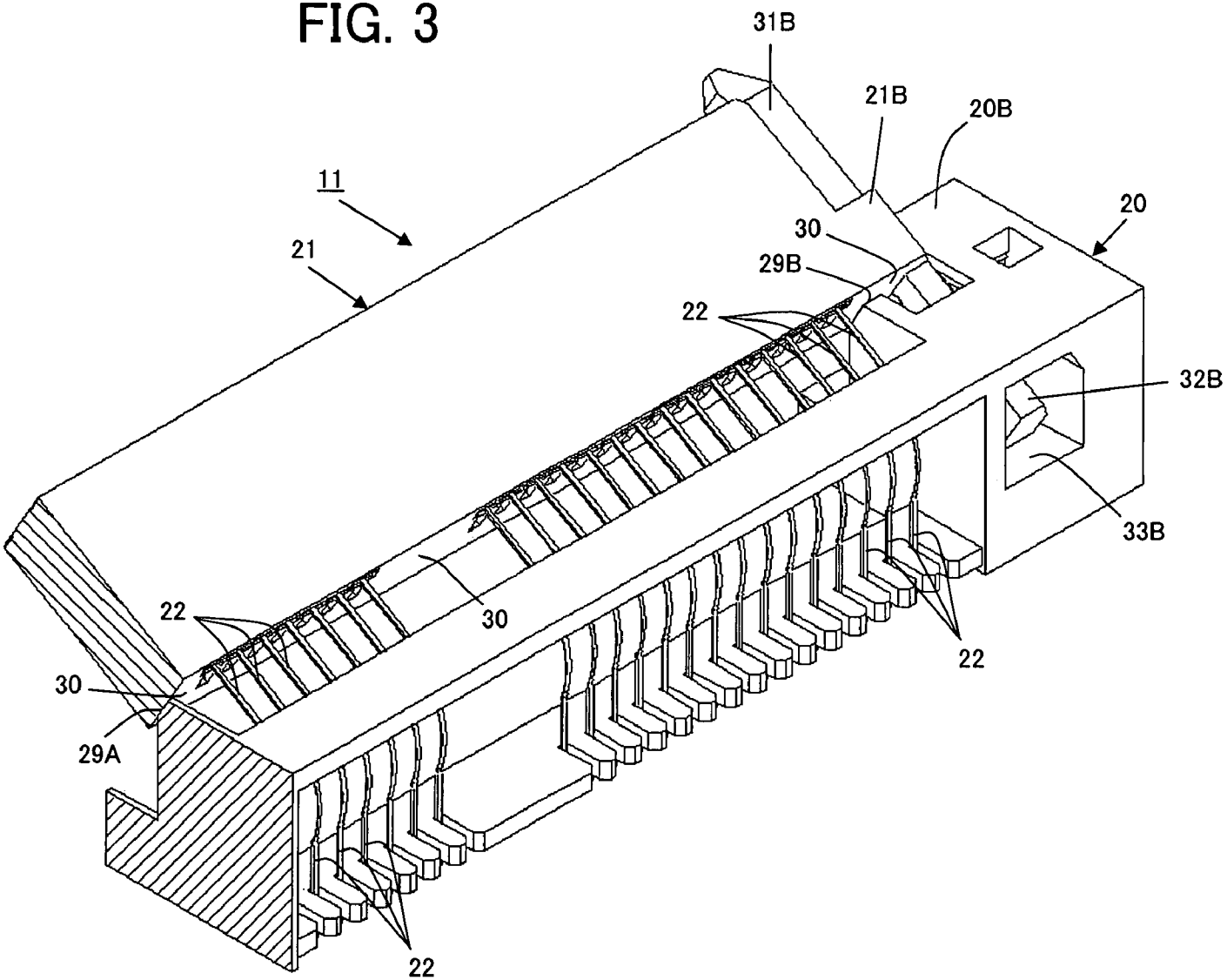
FIG. 3 is a schematic perspective view showing the embodiment shown in FIG. 1, a part of which on the right of line V-V in FIG. 1 is cut out.

FIGS. 1 to 3 show one embodiment of electrical connector according to the present invention, which is put in one of selectable states.

Referring to FIGS. 1 to 3, an electrical connector 11, which constitutes the embodiment of electrical connector according to the present invention, has a fixed housing 20 made of insulator such as plastics or the like and attached to a circuit board 15 such as a solid printed circuit board or the like and a movable housing 21 also made of insulator such as plastics or the like. The movable housing 21 is coupled with the fixed housing 20 through a plurality of conductive contacts 22 arranged along a predetermined direction. Each of the conductive contacts 22 is made of conductive resilient material such as metallic material, and a first portion of each of the conductive contacts 22 is connected with a circuit terminal on the circuit board 15. The conductive contacts 22 thus arranged are operative to force the movable housing 21 to keep away from the fixed housing 20.

In the movable housing 21, connecting hollows 23A and 23B which have respective openings formed on a front end portion of the movable housing 21 and in which a counterpart electrical connector provided on, for example, a hard disc drive is inserted are provided. A second portion of each of the conductive contacts 22, the first portion of which is connected with a circuit terminal on the circuit board 15, is positioned in the connecting hollow 23A or 23B for coming into press-contact with a connecting terminal provided on the counterpart electrical connector. Thereby, the counterpart electrical connector inserted in the connecting hollows 23A and 23B is electrically connected through the conductive contacts 22 with the circuit board 15.

A first engaging mechanism comprises one end portion 20A of the fixed housing 20 in the direction along which the conductive contacts 22 are arranged and one end portion 21A of the movable housing 21 which corresponds to the end portion 20A of the fixed housing 20. Further, a second engaging mechanism comprises the other end portion 20B of the fixed housing 20 in the direction along which the conductive contacts 22 are arranged and the other end portion 21B of the movable housing 21 which corresponds to the end portion 20B of the fixed housing 20.

The first and second engaging mechanisms thus constituted are operative to put the movable housing 21 selectively in a locked state (a first state) in which the movable housing 21 is temporarily fixed to the fixed housing 20 and takes a first posture with which an inserting direction of the counterpart electrical connector to the connecting hollows 23A and 23B is angled to the circuit board 15, as shown in FIGS. 1 to 3, and in a floating state (a second state) in which the movable housing 21 is able to move freely to the fixed housing 20 in a predetermined range and takes a second posture with which the inserting direction of the counterpart electrical connector to the connecting hollows 23A and 23B is in substantially parallel with the circuit board 15. The first and second engaging mechanisms are further operative to allow the movable housing 21 to rotate to the fixed housing 20 so that the inserting direction of the counterpart electrical connector to the connecting hollows 23A and 23B varies in its angle to the circuit board 15.

Figure 4:
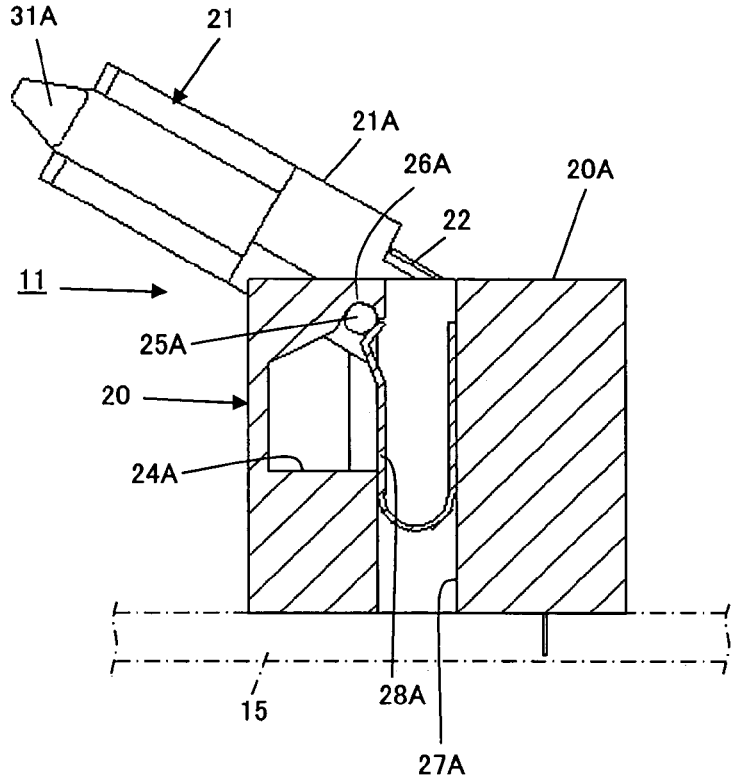
FIG. 4 is a schematic cross sectional view along the line IV-IV in FIG. 1.

The first engaging mechanism comprising the end portion 20A of the fixed housing 20 and the end portion 21A of the movable housing 21 includes a first locking mechanism which comprises a guiding hole 24A provided on the end portion 20A and an engaging projection 25A provided on the end portion 21A, as shown in FIG. 2 and FIG. 4 showing a cross section along line IV-IV in FIG. 1. In the first locking mechanism, the guiding hole 24A has an engaging cutout portion 26A and the engaging projection 25A is operative to move away from the circuit board 15 for engaging with the engaging cutout portion 26A, as shown in FIGS. 2 and 4.

The first engaging mechanism further comprises a through hole 27A provided on the fixed housing 20 for extending perpendicularly to the circuit board 15 to be connected with the guiding hole 24A at a part thereof and a spring member 28A which is positioned in the through hole 27A for coming into press-contact with the engaging projection 25A engaging with the engaging cutout portion 26A to keep the same in its engagement with the engaging cutout portion 26A. The spring member 28A is not always necessary for the engagement of the engaging projection 25A with the engaging cutout portion 26A.

The second engaging mechanism comprising the end portion 20B of the fixed housing 20 and the end portion 21B of the movable housing 21 is constituted in the same manner as the first engaging mechanism. That is, the second engaging mechanism includes a second locking mechanism corresponding to the first locking mechanism and the second locking mechanism comprises a guiding hole, an engaging projection, an engaging cutout portion, a through hole and a spring member (not shown in Figs.) corresponding to the guiding hole 24A, the engaging projection 25A, the engaging cutout portion 26A, the through hole 27A and the spring member 28A, respectively.

Figure 5:
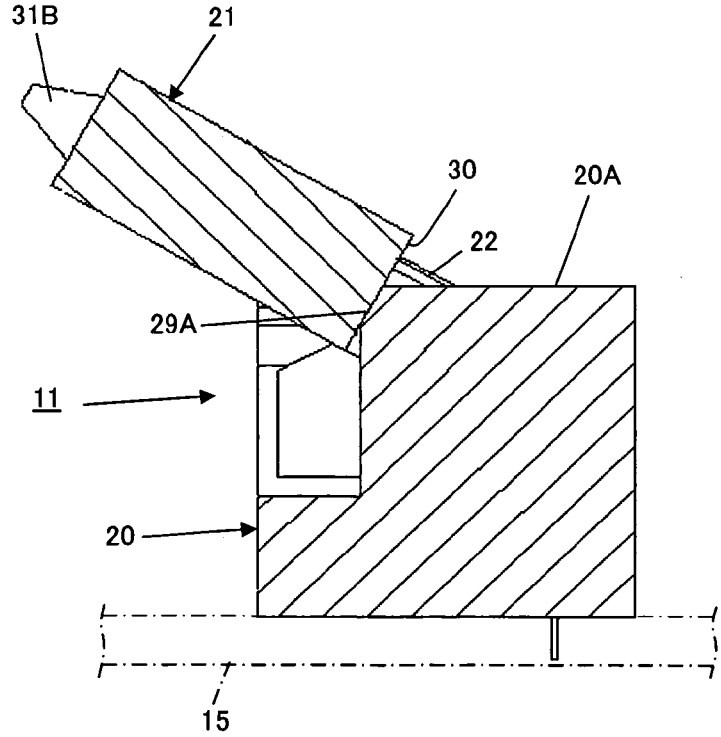
FIG. 5 is a schematic cross sectional view along the line V-V in FIG. 1.
Figure 6:
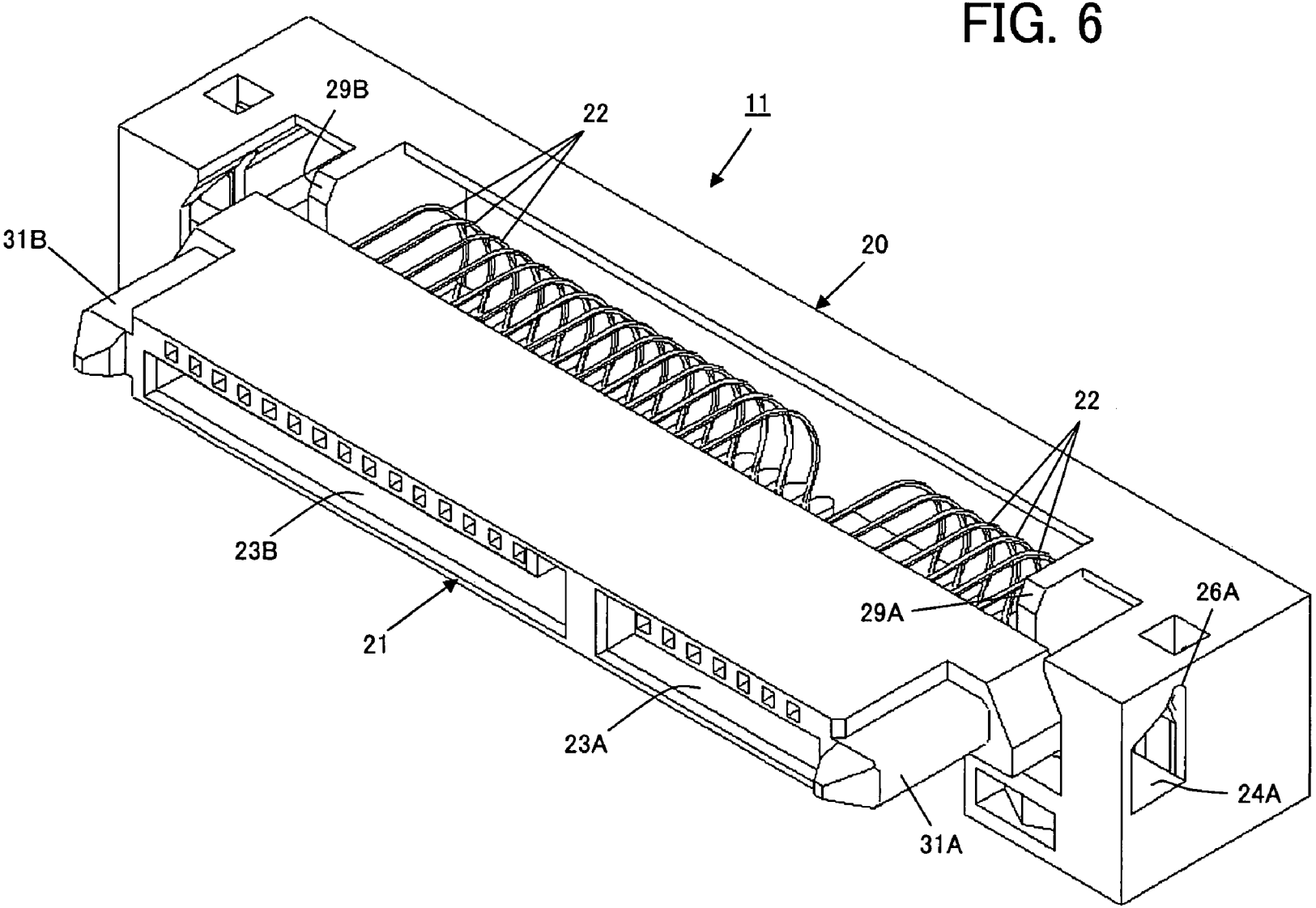
FIGS. 6 and 7 are schematic perspective views showing the embodiment shown in FIG. 1.
Figure 7:
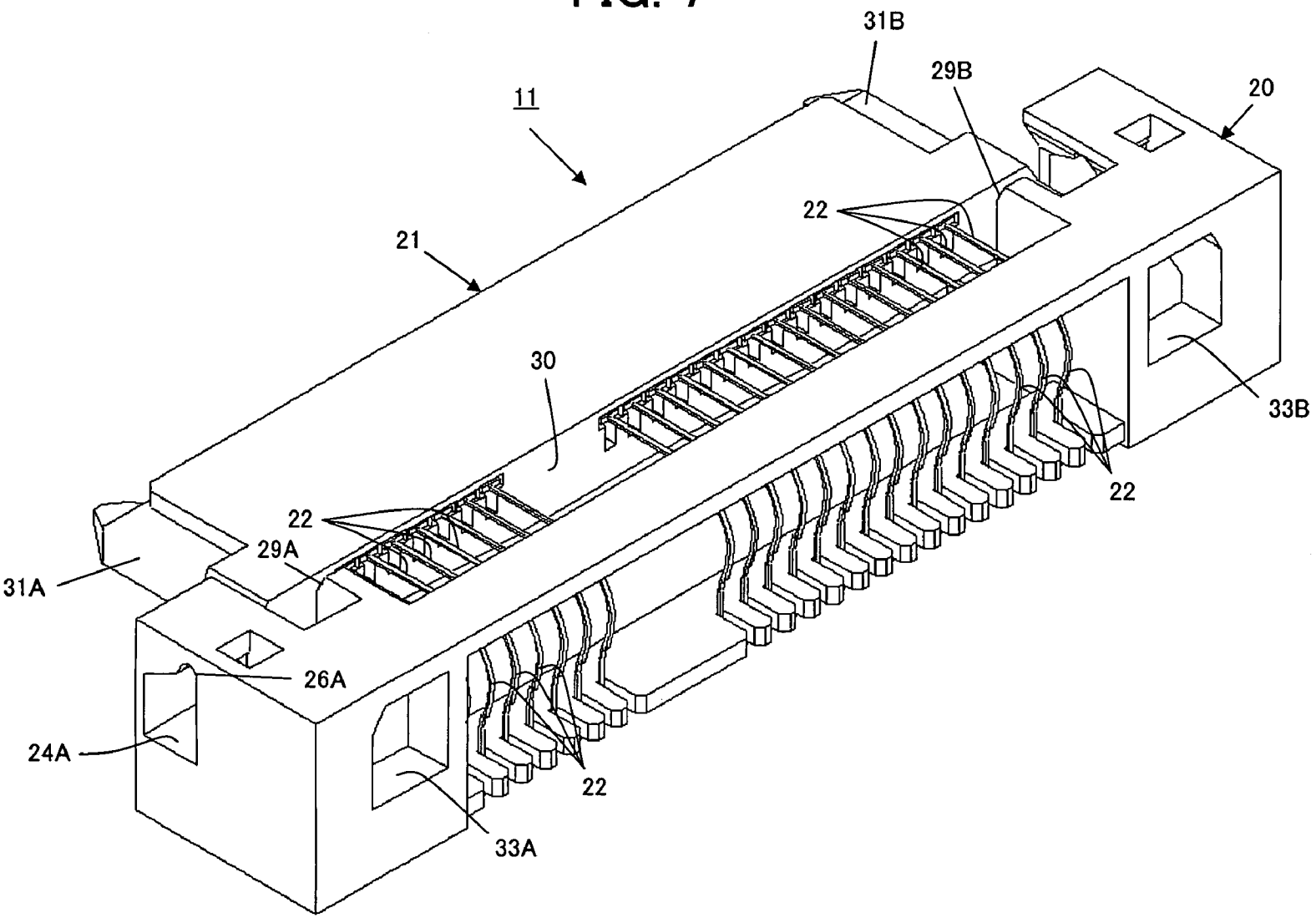
Figure 8:
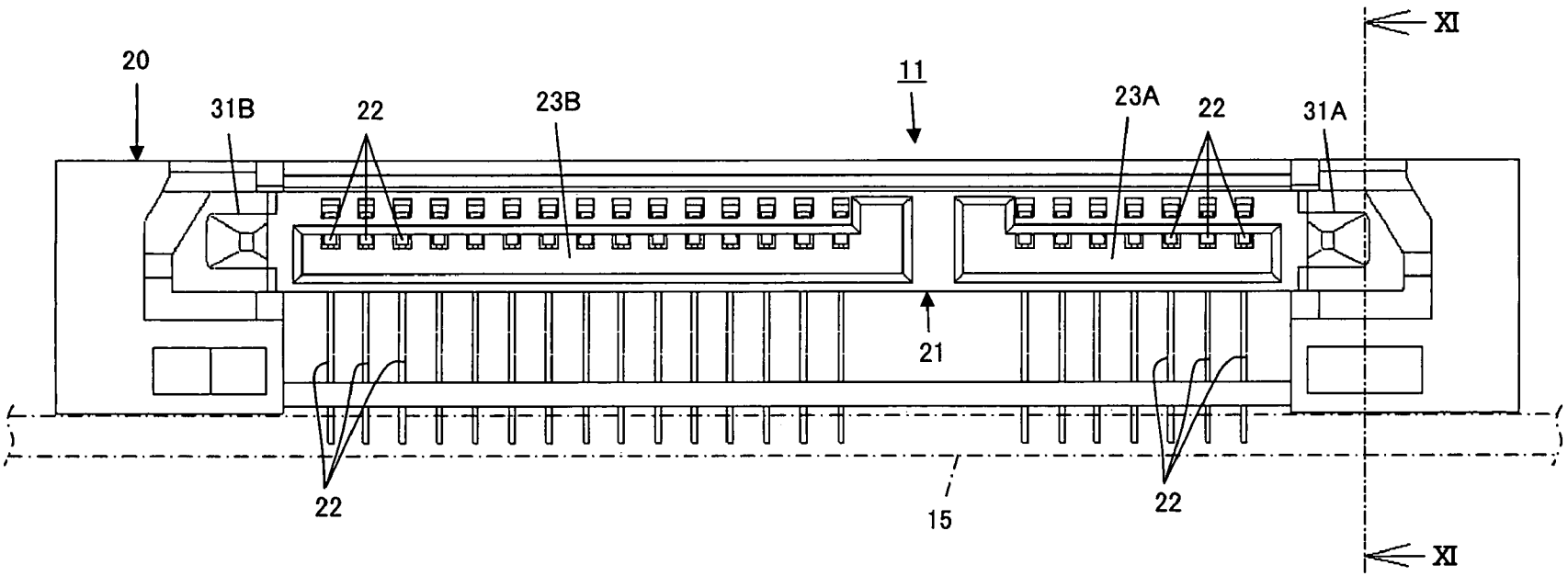
FIG. 8 is a schematic front view showing the embodiment shown in FIG. 1.

When the engaging projection 25A engages with the engaging cutout portion 26A in the first locking mechanism and the engaging projection engages with the engaging cutout portion in the second locking mechanism, the movable housing 21 is temporary fixed to the fixed housing 20 and takes the first posture with which the inserting direction of the counterpart electrical connector to the connecting hollows 23A and 23B slants at an angle of, for example, about 30 degrees to the circuit board 15, as shown in FIGS. 1 to 4 and FIG. 5 showing a cross section along line V-V in FIG. 1. In this situation, supporting portions 29A and 29B provided on the fixed housing 20 come into contact with a rear end portion 30 of the movable housing 21 for supporting the same so that the movable housing 21 is fixed to the fixed housing 20, as shown in FIGS. 3 and 5. Thereby, the movable housing 21 maintains stably the first posture with which the inserting direction of the counterpart electrical connector to the connecting hollows 23A and 23B slants at an angle of about 30 degrees to the circuit board 15.

As for such a fixation of the movable housing 21 to the fixed housing 20, the angle to the circuit board 15 of the inserting direction of the counterpart electrical connector to the connecting hollows 23A and 23B can be optionally set by varying partial shapes of the fixed and movable housings 20 and 21.

Further, since guide portions 21AF and 21BF each having a slanted surface are provided respectively on the end portions 21A and 21B of the movable housing 21 and guide portions 20AF and 20BF each having a slanted surface are provided respectively on the end portions 20A and 20B of the fixed housing 20, as shown in FIG. 1, so that the guide portions 21AF and 21BF are operative to come into contact with the guide portions 20AF and 20BF, respectively, to be guided by the same, the movable housing 21 is stably positioned in relation to the fixed housing 20 in the direction along which the conductive contacts 22 are arranged.

A couple of post-shaped portions 31A and 31B provided on the movable housing 21, between which the openings of the connecting hollows 23A and 23B are put, are operative to guide the counterpart electrical connector inserted in the connecting hollows 23A and 23B. Further, floating guide portions 32A and 32B are also provided on the movable housing 21 to be positioned behind the post-shaped portions 31A and 31B, respectively. The floating guide portion 32A is put in a guiding hole 33A (not shown in FIGS. 1 to 5) provided on the fixed housing 20 and the floating guide portion 32B is put in a guiding hole 33B provided on the fixed housing 20.

The counterpart electrical connector is inserted in the connecting hollows 23A and 23B when the movable housing 21 is temporary fixed to the fixed housing 20 and takes the first posture with which the inserting direction of the counterpart electrical connector to the connecting hollows 23A and 23B slants at the angle of, for example, about 30 degrees to the circuit board 15, as shown in FIGS. 1 to 5. At that time, a couple of portions of the counterpart electrical connector engage with the post-shaped portions 31A and 31B, respectively, to be guided by the same so that the counterpart electrical connector is smoothly inserted in the connecting hollows 23A and 23B.

In the insertion of the counterpart electrical connector in the connecting hollows 23A and 23B thus conducted, the inserting direction of the counterpart electrical connector to the connecting hollows 23A and 23B is set to be at the angle of, for example, about 30 degrees to the circuit board 15 and therefore the counterpart electrical connector is not required to be moved in parallel with the circuit board 15, and in addition, the movable housing 21 is fixed to the fixed housing 20 so that the connecting hollows 23A and 23B do not move. Consequently, the counterpart electrical connector can be easily and surely inserted in the connecting hollows 23A and 23B provided in the movable housing 21 with simple and easy operations.

After the counterpart electrical connector has been inserted in the connecting hollows 23A and 23B provided in the movable housing 21, the movable housing 21 is rotated to the fixed housing 20 so that the inserting direction of the counterpart electrical connector to the connecting hollows 23A and 23B varies in angle to the circuit board 15. In this situation, in the first locking mechanism which is included in the first engaging mechanism comprising the end portion 20A of the fixed housing 20 and the end portion 21A of the movable housing 21, the engaging projection 25A is released from the engagement with the engaging cutout portion 26A, and in the second locking mechanism which is included in the second engaging mechanism comprising the end portion 20B of the fixed housing 20 and the end portion 21B of the movable housing 21, the engaging projection is released from the engagement with the engaging cutout portion. Further, the rear end portion of the movable housing 21 leaves from the supporting portions 29A and 29B provided on the fixed housing 20.

Then, the movable housing 21 is put in the floating state in which the movable housing 21 is able to move freely to the fixed housing 20 in the predetermined range and takes the second posture with which the insertion direction of the counterpart electrical connector to the connecting hollows 23A and 23B is in substantially parallel with the circuit board 15, as shown in FIGS. 6 to 9. The counterpart electrical connector is omitted to be shown in each of FIGS. 6 to 9.

Figure 10:
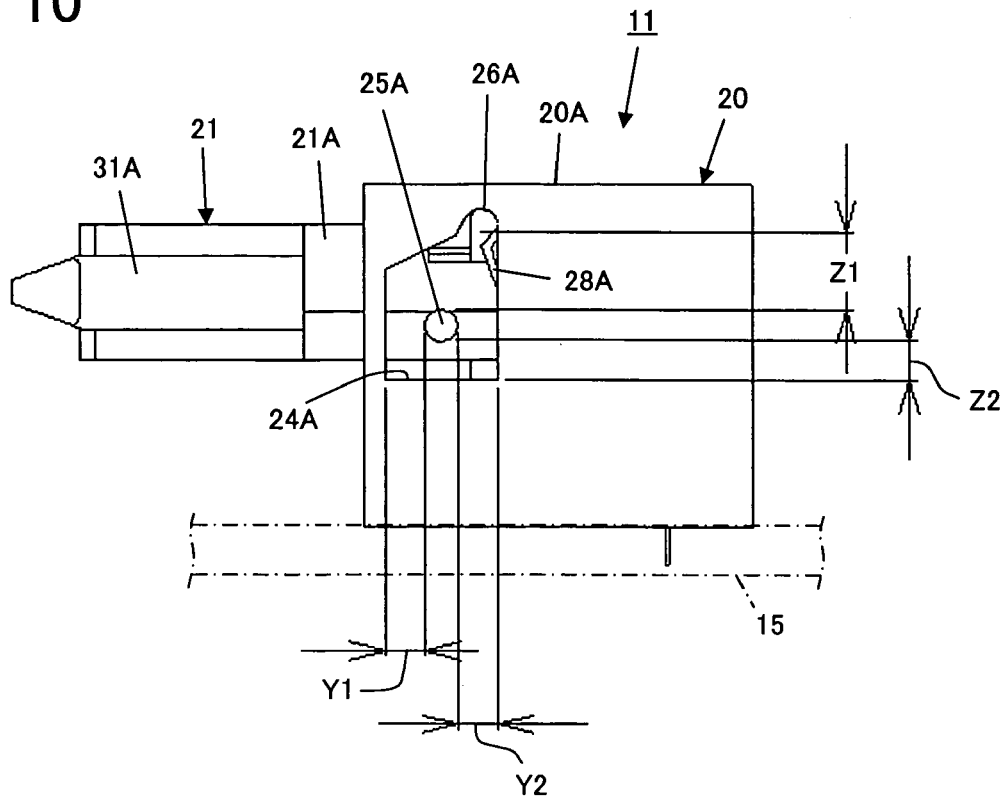
FIG. 10 is a schematic side view showing the embodiment shown in FIG. 1.

When the movable housing 21 is put in the floating state in which the movable housing 21 is able to move freely to the fixed housing 20 in the predetermined range and takes the second posture with which the insertion direction of the counterpart electrical connector to the connecting hollows 23A and 23B is in substantially parallel with the circuit board 15, in the first locking mechanism which is included in the first engaging mechanism comprising the end portion 20A of the fixed housing 20 and the end portion 21A of the movable housing 21, the engaging projection 25A is released from the engagement with the engaging cutout portion 26A to be at a small distance from the engaging cutout portion 26A and the spring member 28A, as shown in FIG. 10, and similarly, in the second locking mechanism which is included in the second engaging mechanism comprising the end portion 20B of the fixed housing 20 and the end portion 21B of the movable housing 21, the engaging projection is released from the engagement with the engaging cutout portion to be at a small distance from the engaging cutout portion and the spring member.

Thereby, the movable housing 21 is supported only by the conductive contacts arranged along the predetermined direction with the respective first portions connected with the circuit terminals on the circuit board 15, so that the movable housing 21 accompanied with the counterpart electrical connector is able to move freely to the fixed housing 20 in the predetermined range and takes the second posture with which the insertion direction of the counterpart electrical connector to the connecting hollows 23A and 23B is in substantially parallel with the circuit board 15. As a result, vibrations and shocks acting on an apparatus or device, such as the hard disc drive, on which the counterpart electrical connector is provided are absorbed by the movable housing 21 so that the apparatus or device on which the counterpart electrical connector is provided is protected against the vibrations and shocks acting thereon.

Assuming that the direction along which the conductive contacts 22 are arranged is referred to as an X direction, a direction in parallel with the circuit board 15 and perpendicular to the X direction is referred to as a Y direction and a direction perpendicular to the circuit board 15 is referred to as a Z direction, the movable housing 21 accompanied with the counterpart electrical connector and put in the floating state moves in the X, Y and Z directions in such a manner as described below.

Figure 9:
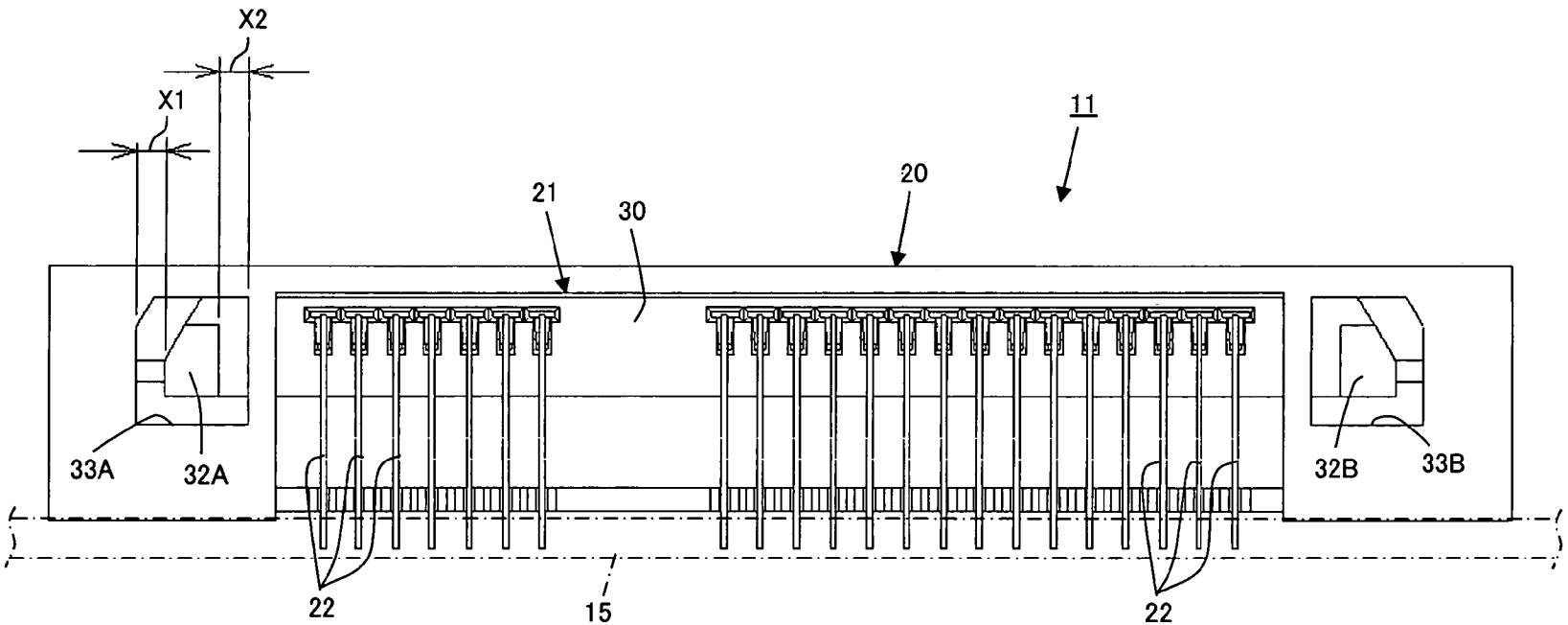
FIG. 9 is a schematic rear view showing the embodiment shown in FIG. 1.

A movable range in the X direction of the movable housing 21 is determined by a movable range in the X direction of the floating guide portion 32A provided on the movable housing 21 in the guiding hole 33A provided on the fixed housing 20 (or a movable range in the X direction of the floating guide portion 32B provided on the movable housing 21 in the guiding hole 33B provided on the fixed housing 20), as understandable on FIG. 9. The maximum moving distance in the X direction of the floating guide portion 32A in the guiding hole 33A is the sum of two distances X1 and X2 shown in FIG. 9, namely, X1+X2. Accordingly, the maximum moving distance in the X direction of the movable housing 21 is X1+X2, so that the movable range in the X direction of the movable housing 21 is set to be within the maximum distance X1+X2.

A movable range in the Y direction of the movable housing 21 is determined by a movable range in the Y direction of the engaging projection 25A provided on the movable housing 21 in the guiding hole 24A provided on the fixed housing 20 (or a movable range in the Y direction of the engaging projection provided on the end portion 21B of the movable housing 21 in the guiding hole provided on the end portion 20B of the fixed housing 20), as understandable on FIG. 10. The maximum moving distance in the Y direction of the engaging projection 25A in the guiding hole 24A is the sum of two distances Y1 and Y2 shown in FIG. 10, namely, Y1+Y2. Accordingly, the maximum moving distance in the Y direction of the movable housing 21 is Y1+Y2, so that the movable range in the Y direction of the movable housing 21 is set to be within the maximum distance Y1+Y2.

Figure 11:
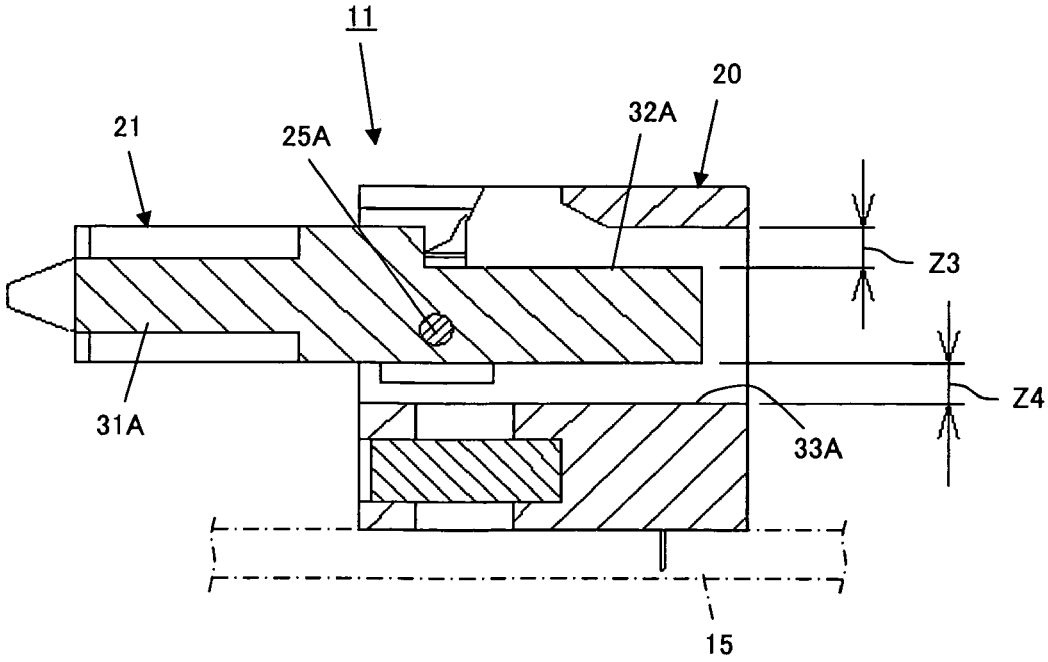
FIG. 11 is a schematic cross sectional view along line XI-XI in FIG. 8.
Figure 12:
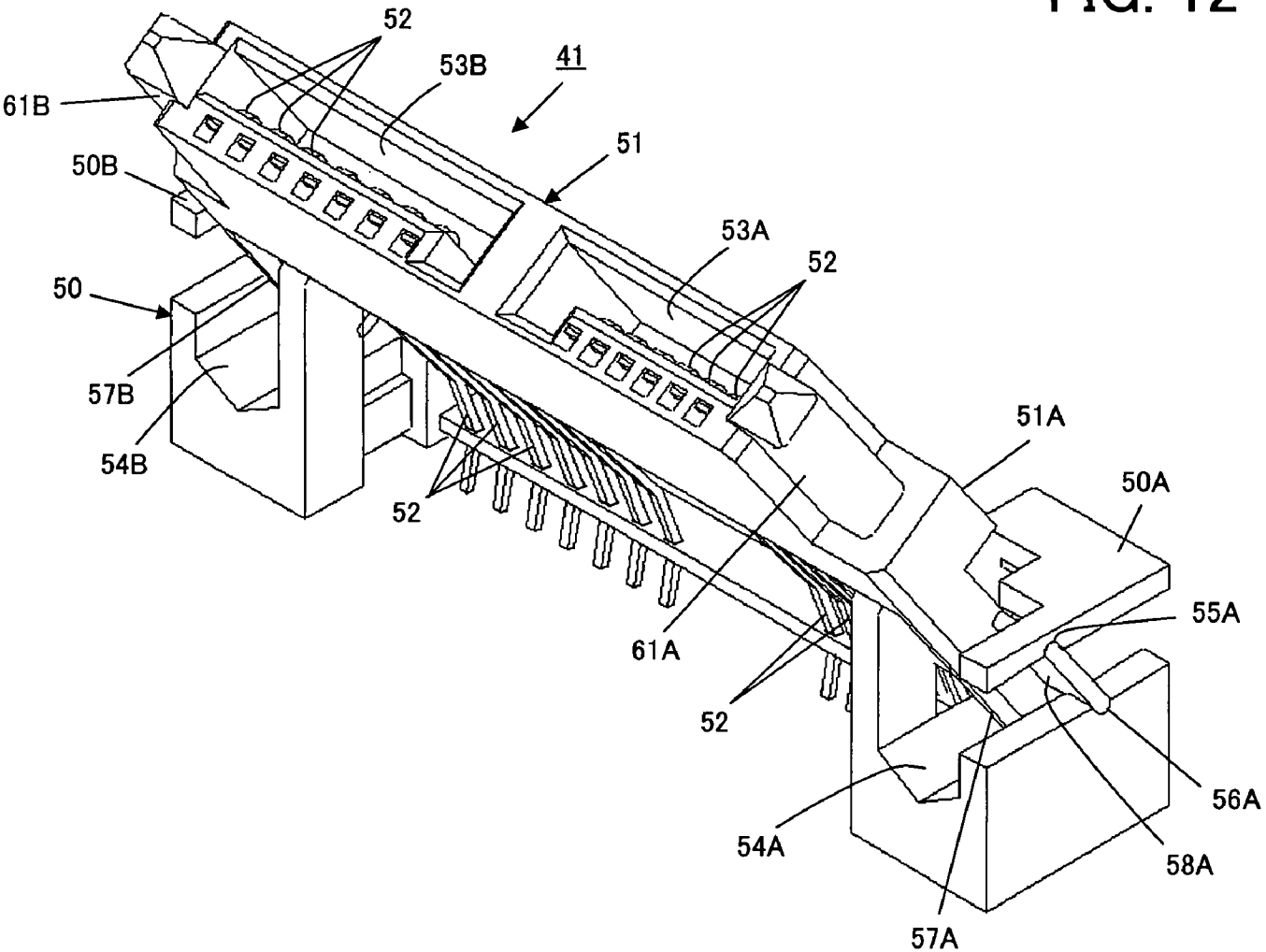
FIG. 12 is a schematic perspective view showing another embodiment of electrical connector according to the present invention.
Figure 13:
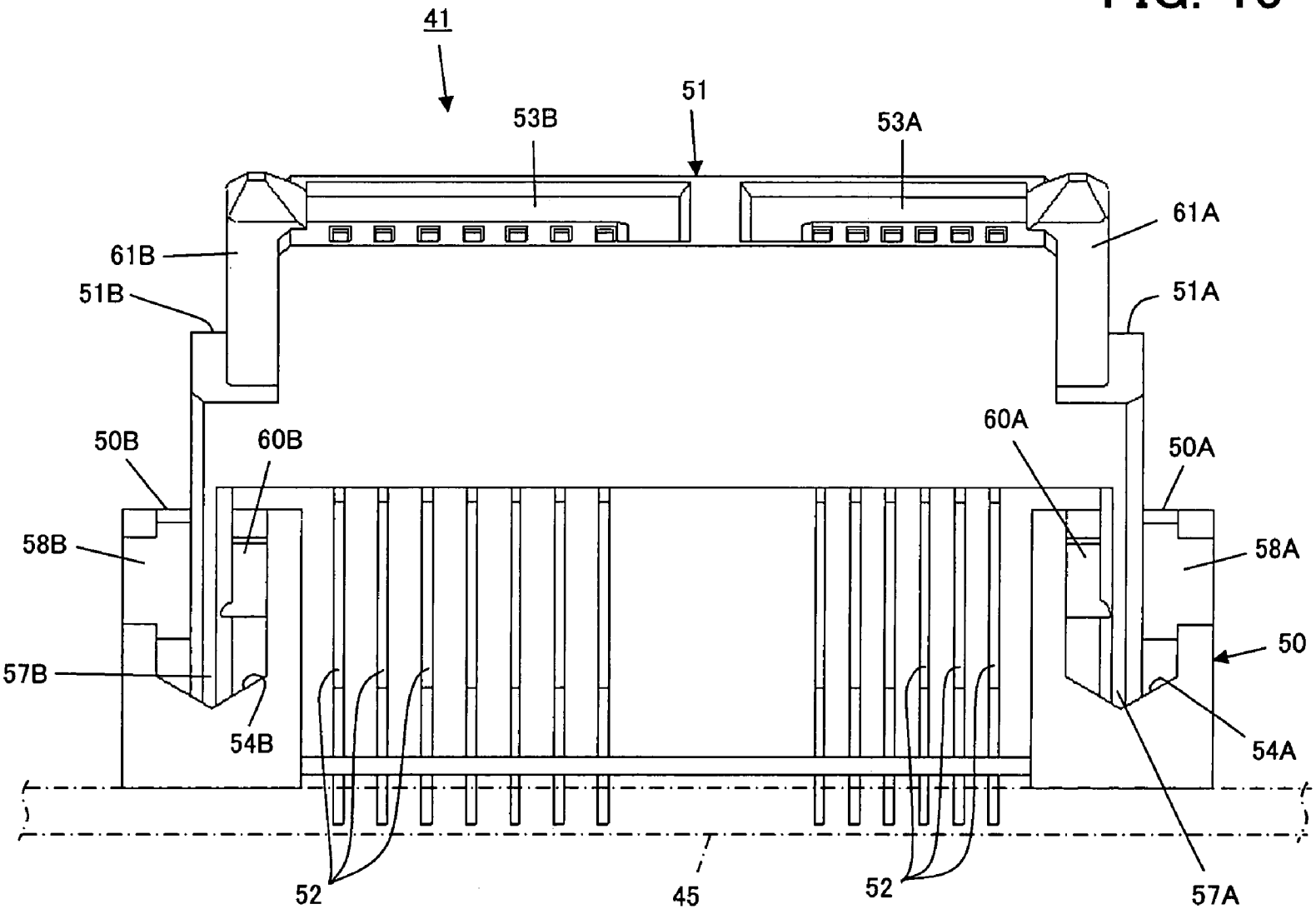
FIG. 13 is a schematic front view showing the embodiment shown in FIG. 12.
Figure 14:
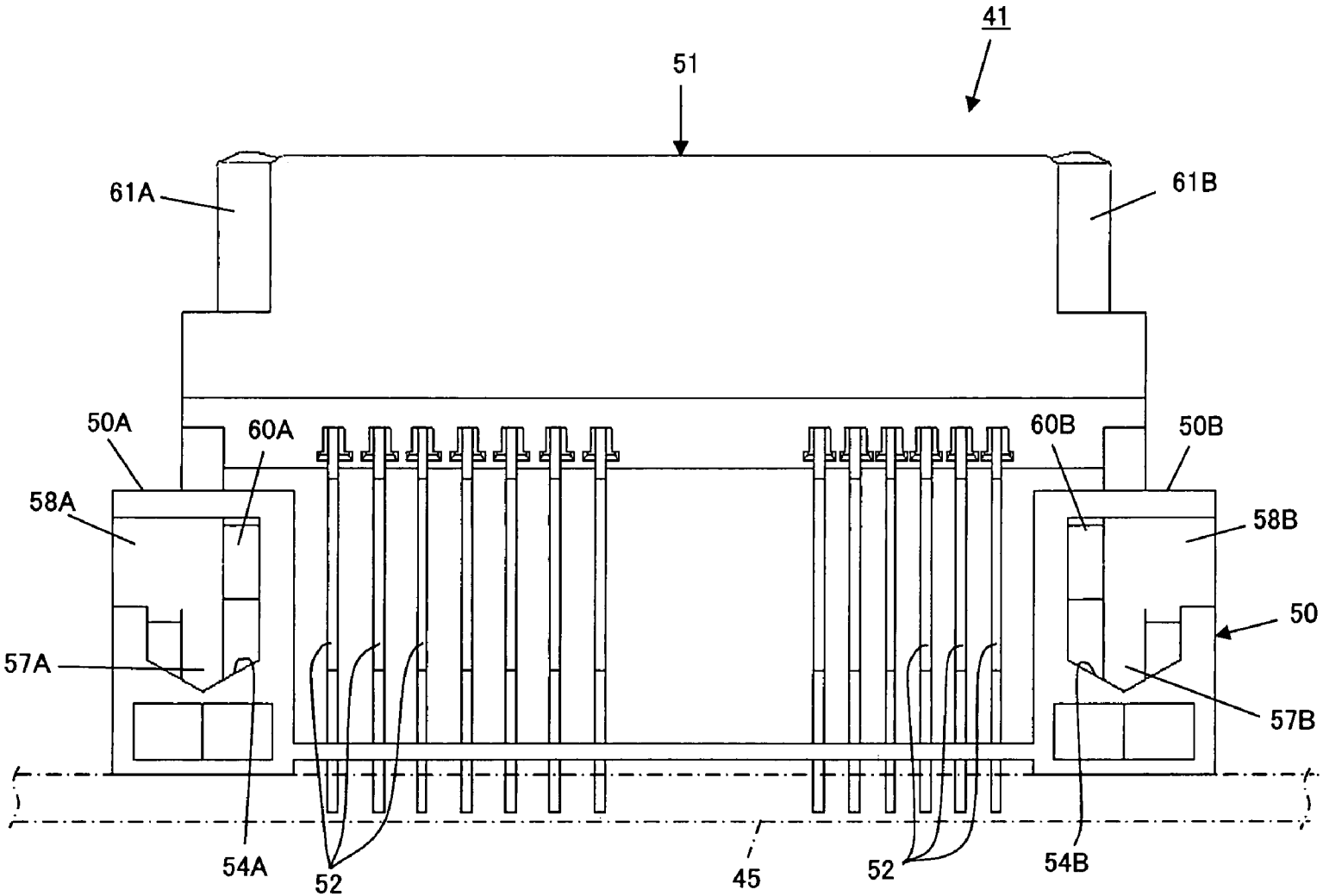
FIG. 14 is a schematic rear view showing the embodiment shown in FIG. 12.
Figure 15:
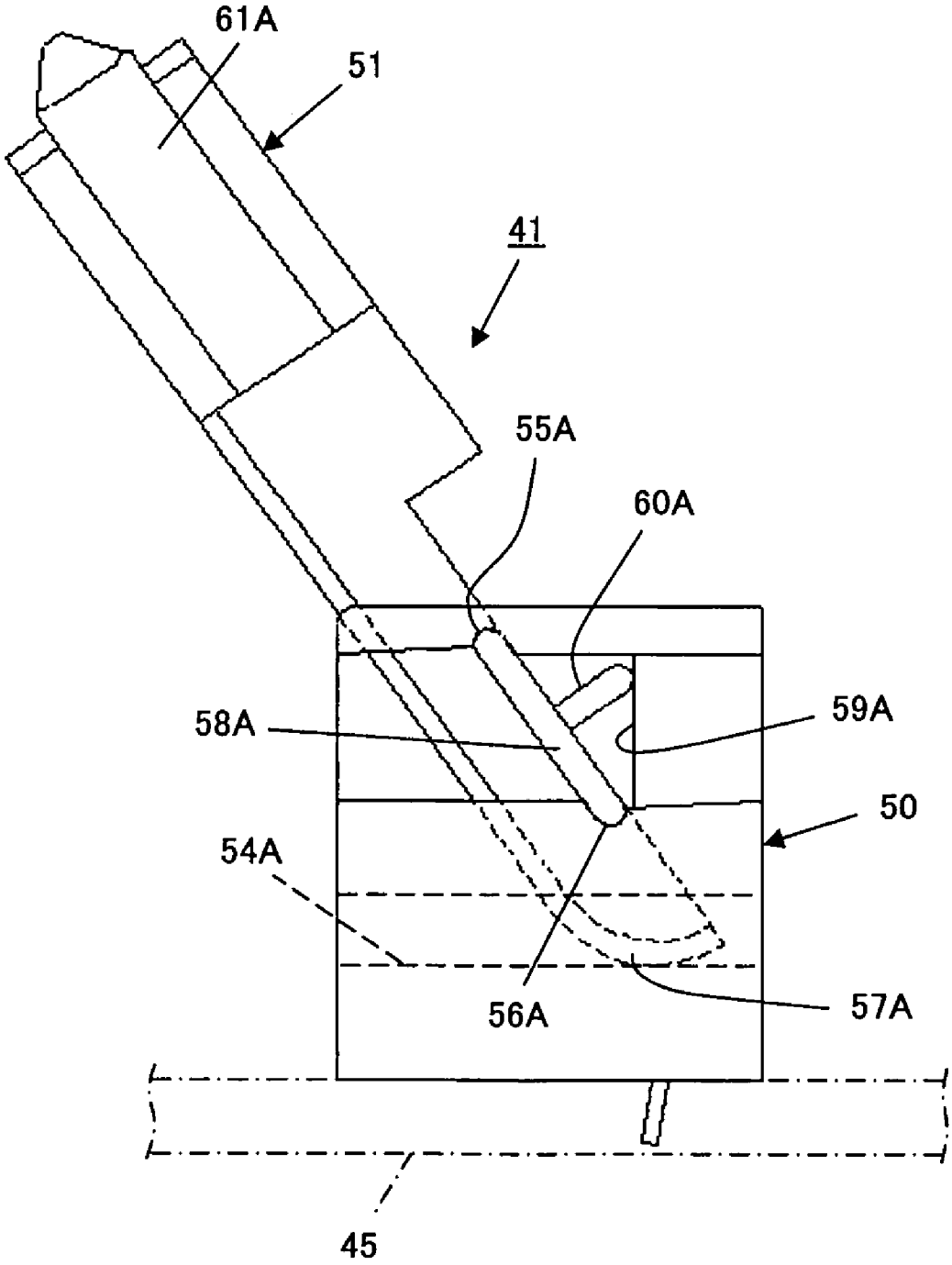
FIG. 15 is a schematic side view showing the embodiment shown in FIG. 12.
Figure 16:
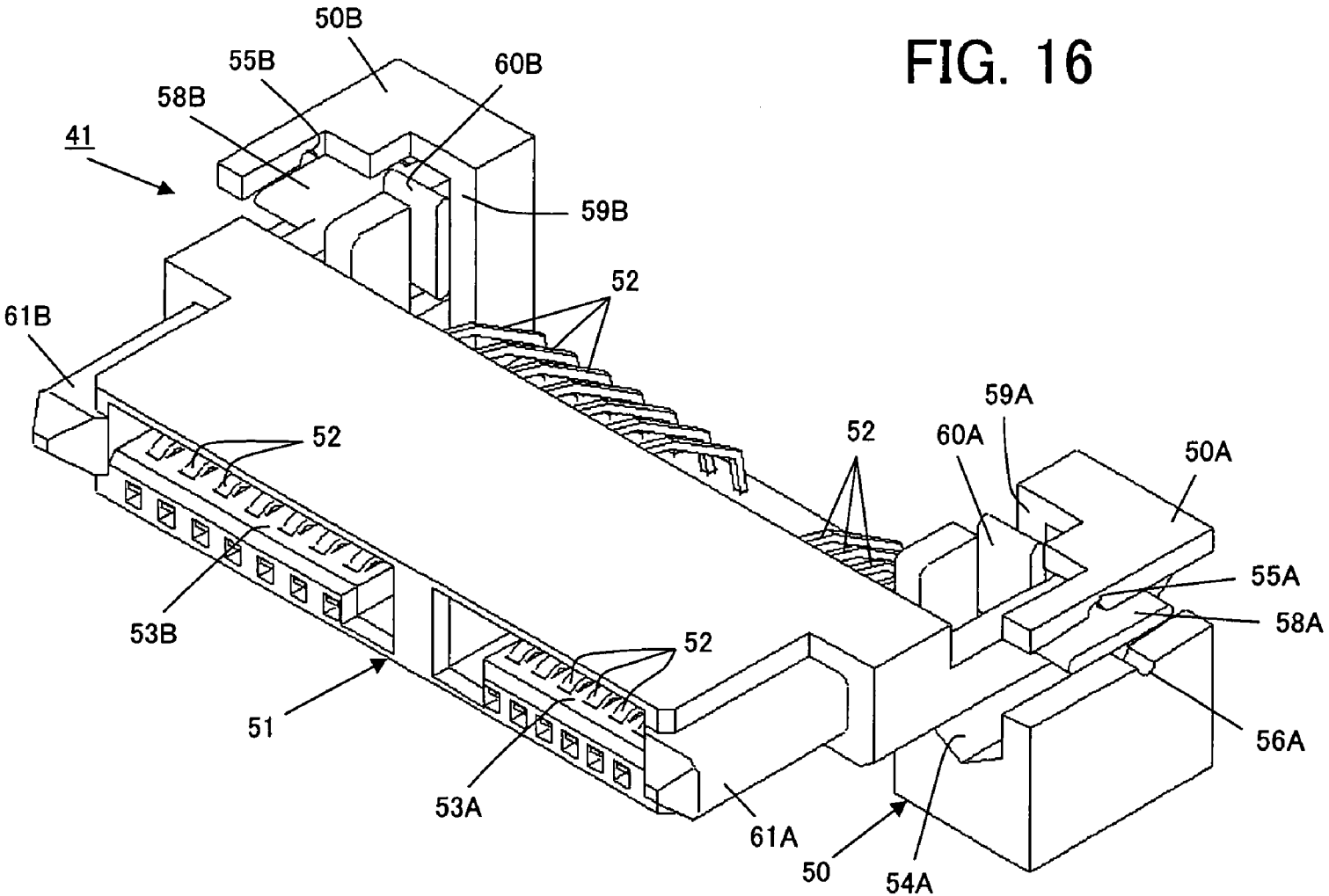
FIG. 16 is a schematic perspective view showing the embodiment shown in FIG. 12.

A movable range in the Z direction of a central portion in the Y direction of the movable housing 21 is determined by a movable range in the Z direction of the engaging projection 25A provided on the movable housing 21 in the guiding hole 24A provided on the fixed housing 20 (or a movable range in the Z direction of the engaging projection provided on the end portion 21B of the movable housing 21 in the guiding hole provided on the end portion 20B of the fixed housing 20), as understandable on FIG. 10. A movable range in the Z direction of each of the floating guide portions 32A and 32B provided on the movable housing 21 is determined by a movable range in the Z direction of the floating guide portion 32A in the guiding hole 33A provided on the fixed housing 20 (or a movable range in the Z direction of the floating guide portion 32B in the guiding hole 33B provided on the fixed housing 20), as understandable on FIG. 11 showing a cross section along line XI-XI in FIG. 8.

The maximum moving distance in the Z direction of the engaging projection 25A in the guiding hole 24A is the sum of two distances Z1 and Z2 shown in FIG. 10, namely, Z1+Z2. Accordingly, the maximum moving distance in the Z direction of the central portion in the Y direction of the movable housing 21 is Z1+Z2, so that the movable range in the Z direction of the central portion in the Y direction of the movable housing 21 is set to be within the maximum distance Z1+Z2. The maximum moving distance in the Z direction of the floating guide portion 32A in the guiding hole 33A is the sum of two distances Z3 and Z4 shown in FIG. 11, namely, Z3+Z4. Accordingly, the maximum moving distance in the Z direction of each of the floating guide portions 32A and 32B provided on the movable housing 21 is Z3+Z4, so that the movable range in the Z direction of each of the floating guide portions 32A and 32B provided on the movable housing 21 is set to be within the maximum distance Z3+Z4.

FIGS. 12 to 15 show another embodiment of electrical connector according to the present invention, which is put in one of selectable states.

Referring to FIGS. 12 to 15, an electrical connector 41, which constitutes one of the embodiments of electrical connector according to the present invention, has a fixed housing 50 made of insulator such as plastics or the like and attached to a circuit board 45 such as a solid printed circuit board or the like and a movable housing 51 also made of insulator such as plastics or the like. The movable housing 51 is coupled with the fixed housing 50 through a plurality of conductive contacts 52 arranged along a predetermined direction. Each of the conductive contacts 52 is made of conductive resilient material such as metallic material, and a first portion of each of the conductive contacts 52 is connected with a circuit terminal on the circuit board 45. The conductive contacts 52 thus arranged are operative to force the movable housing 51 to keep away from the fixed housing 50.

In the movable housing 51 connecting hollows 53A and 53B which have respective openings formed on a front end portion of the movable housing 51 and in which a counterpart electrical connector provided on, for example, a hard disc drive is inserted are provided. A second portion of each of the conductive contacts 52, the first portion of which is connected with the circuit terminal on the circuit board 45, is positioned in the connecting hollow 53A or 53B for coming into press-contact with a connecting terminal provided on the counterpart electrical connector. Thereby, the counterpart electrical connector inserted in the connecting hollows 53A and 53B is electrically connected through the conductive contacts 52 with the circuit board 45.

A first engaging mechanism comprises one end portion 50A of the fixed housing 50 in the direction along which the conductive contacts 52 are arranged and one end portion 51A of the movable housing 51 which corresponds to the end portion 50A of the fixed housing 50. Further, a second engaging mechanism comprises the other end portion 50B of the fixed housing 50 in the direction along which the conductive contacts 52 are arranged and the other end portion 51B of the movable housing 51 which corresponds to the end portion 50B of the fixed housing 50.

The first and second engaging mechanisms thus constituted are operative to put the movable housing 51 selectively in a locked state (a first state) in which the movable housing 51 is temporarily fixed to the fixed housing 50 and takes a first posture with which an inserting direction of the counterpart electrical connector to the connecting hollows 53A and 53B is angled to the circuit board 45, as shown in FIGS. 12 to 15, and in a floating state (a second state) in which the movable housing 51 is able to move freely to the fixed housing 50 in a predetermined range and takes a second posture with which the inserting direction of the counterpart electrical connector to the connecting hollows 53A and 53B is in substantially parallel with the circuit board 45. The first and second engaging mechanisms are further operative to allow the movable housing 51 to rotate to the fixed housing 50 so that the inserting direction of the counterpart electrical connector to the connecting hollows 53A and 53B varies in its angle to the circuit board 45.

The first engaging mechanism comprising the end portion 50A of the fixed housing 50 and the end portion 51A of the movable housing 51 includes a first locking mechanism which comprises a V-shaped guiding groove 54A and a pair of engaging grooves 55A and 56A, which are provided on the end portion 50A of the fixed housing 50, and a contacting portion 57A for coming into contact with the V-shaped guiding groove 54A to be guided by the same, a board-shaped engaging portion 58A for engaging with the engaging grooves 55A and 56A to be positioned by the same and a board-shaped contacting portion 60A for coming into contacting with a contacting surface 59A provided on the end portion 50A, which are provided on the end portion 51A of the movable housing 51. In the first locking mechanism, the contacting portion 57A has a V-shaped edge corresponding to the V-shaped guiding groove 54A and each of opposite ends of the board-shaped engaging portion 58A is shaped to correspond to the engaging grooves 55A or 56A.

The second engaging mechanism comprising the end portion 50B of the fixed housing 50 and the end portion 51B of the movable housing 51 is constituted in the same manner as the first engaging mechanism. That is, the second engaging mechanism includes a second locking mechanism corresponding to the first locking mechanism and the second locking mechanism comprises a V-shaped guiding groove 54B, a pair of engaging grooves 55B and 56B (not shown in FIGS. 12~15), a contacting portion 57B, a board-shaped engaging portion 58B, a contacting surface 59B (not shown in FIGS. 12~15) and a board-shaped contacting portion 60B, which are correspond to the V-shaped guiding groove 54A, the engaging grooves 55A and 56A, the contacting portion 57A, the board-shaped engaging portion 58A, the contacting surface 59A and the board-shaped contacting portion 60A, respectively.

When the contacting portion 57A comes into contact with the V-shaped guiding groove 54A to be guided by the same, the board-shaped engaging portion 58A engages with the engaging grooves 55A and 56A to be positioned by the same and the board-shaped contacting portion 60A comes into contact with the contacting surface 59A in the first locking mechanism and the contacting portion 57B comes into contact with the V-shaped guiding groove 54B to be guided by the same, the board-shaped engaging portion 58B engages with the engaging grooves 55B and 56B (The engaging groove 56B does not appear on the drawings.) to be positioned by the same and the board-shaped contacting portion 60B comes into contact with the contacting surface 59B in the second locking mechanism, the movable housing 51 is temporary fixed to the fixed housing 50 and takes the first posture with which the inserting direction of the counterpart electrical connector to the connecting hollows 53A and 53B slants at an angle of, for example, about 30 degrees to the circuit board 45, as shown in FIGS. 12 to 15. The angle to the circuit board 45 of the inserting direction of the counterpart electrical connector to the connecting hollows 53A and 53B can be optionally set by varying partial shapes of the fixed and movable housings 50 and 51.

In a fixation of the movable housing 51 to the fixed housing 50 thus conducted, the contacting portions 57A and 57B provided on the movable housing 51 to have the respective V-shaped edges are guided by the V-shaped guiding grooves 54A and 54B provided on the fixed housing 50, respectively, and therefore the movable housing 51 is stably positioned in relation to the fixed housing 50 at a predetermined position in the direction along which the conductive contacts 52 are arranged.

A couple of post-shaped portions 61A and 61B provided on the movable housing 51, between which the openings of the connecting hollows 53A and 53B are put, are operative to guide the counterpart electrical connector inserted in the connecting hollows 53A and 53B.

The counterpart electrical connector is inserted in the connecting hollows 53A and 53B when the movable housing 51 is temporary fixed to the fixed housing 50 and takes the first posture with which the inserting direction of the counterpart electrical connector to the connecting hollows 53A and 53B slants at the angle of, for example, about 30 degrees to the circuit board 45, as shown in FIGS. 12 to 15. At that time, a couple of portions of the counterpart electrical connector engage with the post-shaped portions 61A and 61B, respectively, to be guided by the same so that the counterpart electrical connector is smoothly inserted in the connecting hollows 53A and 53B.

In the insertion of the counterpart electrical connector in the connecting hollows 53A and 53B thus conducted, the inserting direction of the counterpart electrical connector to the connecting hollows 53A and 53B is set to be at the angle of, for example, about 30 degrees to the circuit board 45 and therefore the counterpart electrical connector is not required to be moved in parallel with the circuit board 45, and in addition, the movable housing 51 is fixed to the fixed housing 50 so that the connecting hollows 53A and 53B do not move. Consequently, the counterpart electrical connector can be easily and surely inserted in the connecting hollows 53A and 53B provided in the movable housing 51 with simple and easy operations.

After the counterpart electrical connector has been inserted in the connecting hollows 53A and 53B provided in the movable housing 51, the movable housing 51 is rotated to the fixed housing 50 so that the inserting direction of the counterpart electrical connector to the connecting hollows 53A and 53B varies in angle to the circuit board 45. In this situation, in the first locking mechanism which is included in the first engaging mechanism comprising the end portion 50A of the fixed housing 50 and the end portion 51A of the movable housing 51, the board-shaped engaging portion 58A is released from the engagement with the engaging grooves 55A and 56A, and in the second locking mechanism which is included in the second engaging mechanism comprising the end portion 50B of the fixed housing 50 and the end portion 51B of the movable housing 51, the board-shaped engaging portion 58B is released from the engagement with the engaging grooves 55B and 56B. Further, the contacting portions 57A provided on the movable housing 51 is released from the guidance by the V-shaped guiding grooves 54A provided on the fixed housing 50 and the contacting portions 57B provided on the movable housing 51 is also released from the guidance by the V-shaped guiding grooves 54B provided on the fixed housing 50.

Then, the movable housing 51 is put in the floating state in which the movable housing 51 is able to move freely to the fixed housing 50 in the predetermined range and takes the second posture with which the insertion direction of the counterpart electrical connector to the connecting hollows 53A and 53B is in substantially parallel with the circuit board 45, as shown in FIGS. 16 to 20. The counterpart electrical connector is omitted to be shown in each of FIGS. 16 to 20.

When the movable housing 51 is put in the floating state in which the movable housing 51 is able to move freely to the fixed housing 50 in the predetermined range and takes the second posture with which the insertion direction of the counterpart electrical connector to the connecting hollows 53A and 53B is in substantially parallel with the circuit board 45, in the first locking mechanism, the board-shaped engaging portion 58A is released from the engagement with the engaging grooves 55A and 56A and the contacting portion 57A is also released from the guidance by the V-shaped guiding groove 54A, and similarly, in the second locking mechanism, the board-shaped engaging portion 58B is released from the engagement with the engaging grooves 55B and 56B and the contacting portion 57B is also released from the guidance by the V-shaped guiding groove 54B. Further, in the first locking mechanism, the board-shaped contacting portion 60A leaves from the contacting surface 59A to be at a small distance from the same, and in the second locking mechanism, the board-shaped contacting portion 60B also leaves from the contacting surface 59B to be at a small distance from the same.

Thereby, the movable housing 51 is supported only by the conductive contacts 52 arranged along the predetermined direction with the respective first portions connected with the circuit terminals on the circuit board 45, so that the movable housing 51 accompanied with the counterpart electrical connector is able to move freely to the fixed housing 50 in the predetermined range and takes the second posture with which the insertion direction of the counterpart electrical connector to the connecting hollows 53A and 53B is in substantially parallel with the circuit board 45. As a result, vibrations and shocks acting on an apparatus or device, such as the hard disc drive, on which the counterpart electrical connector is provided are absorbed by the movable housing 51 so that the apparatus or device on which the counterpart electrical connector is provided is protected against the vibrations and shocks acting thereon.

In the case of the electrical connector 41 thus constituted also, assuming that the direction along which the conductive contacts 52 are arranged is referred to as an X direction, a direction in parallel with the circuit board 45 and perpendicular to the X direction is referred to as a Y direction and a direction perpendicular to the circuit board 45 is referred to as a Z direction, the movable housing 51 accompanied with the counterpart electrical connector and put in the floating state moves in the X, Y and Z directions in such a manner as described below.

Figure 18:
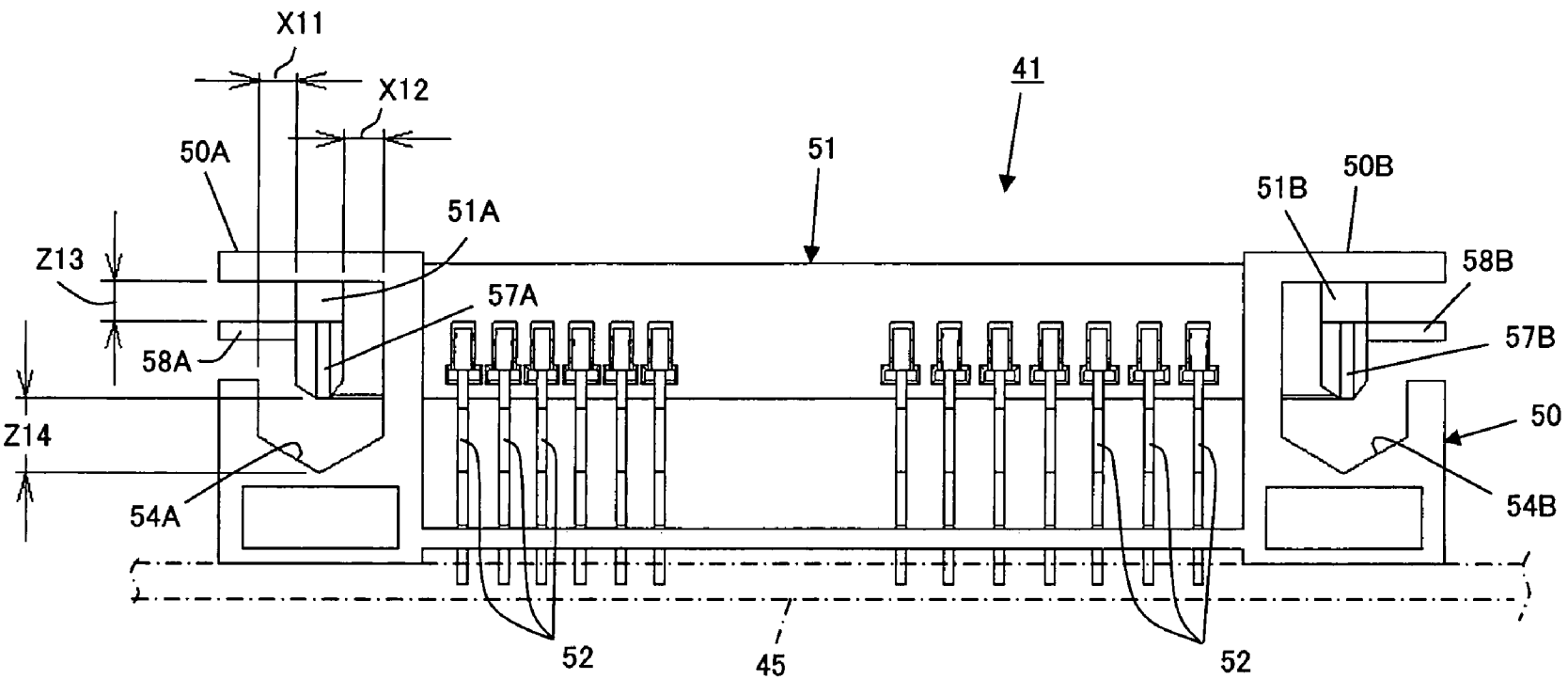
FIG. 18 is a schematic rear view showing the embodiment shown in FIG. 12.

A movable range in the X direction of the movable housing 51 is determined by a movable range in the X direction of the contacting portion 57A provided on the movable housing 51 in the V-shaped guiding grooves 54A provided on the fixed housing 50 (or a movable range in the X direction of the contacting portion 57B provided on the movable housing 51 in the V-shaped guiding grooves 54B provided on the fixed housing 50), as understandable on FIG. 18. The maximum moving distance in the X direction of the contacting portion 57A in the V-shaped guiding grooves 54A is the sum of two distances X1 and X12 shown in FIG. 18, namely, X11+X12. Accordingly, the maximum moving distance in the X direction of the movable housing 51 is X11+X12, so that the movable range in the X direction of the movable housing 51 is set to be within the maximum distance X11+X12.

Figure 19:
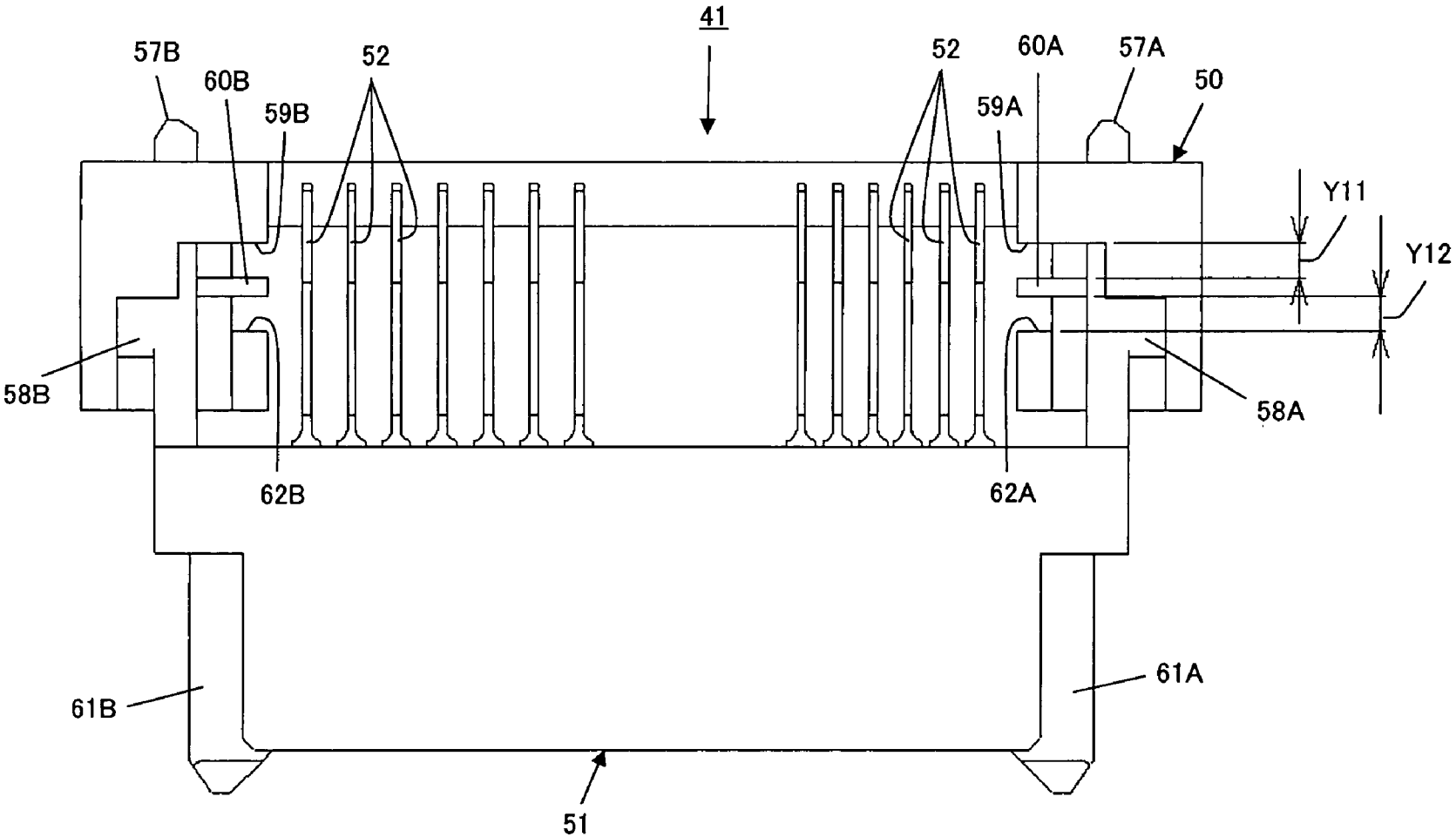
FIG. 19 is a schematic plane view showing the embodiment shown in FIG. 12.
Figure 20:
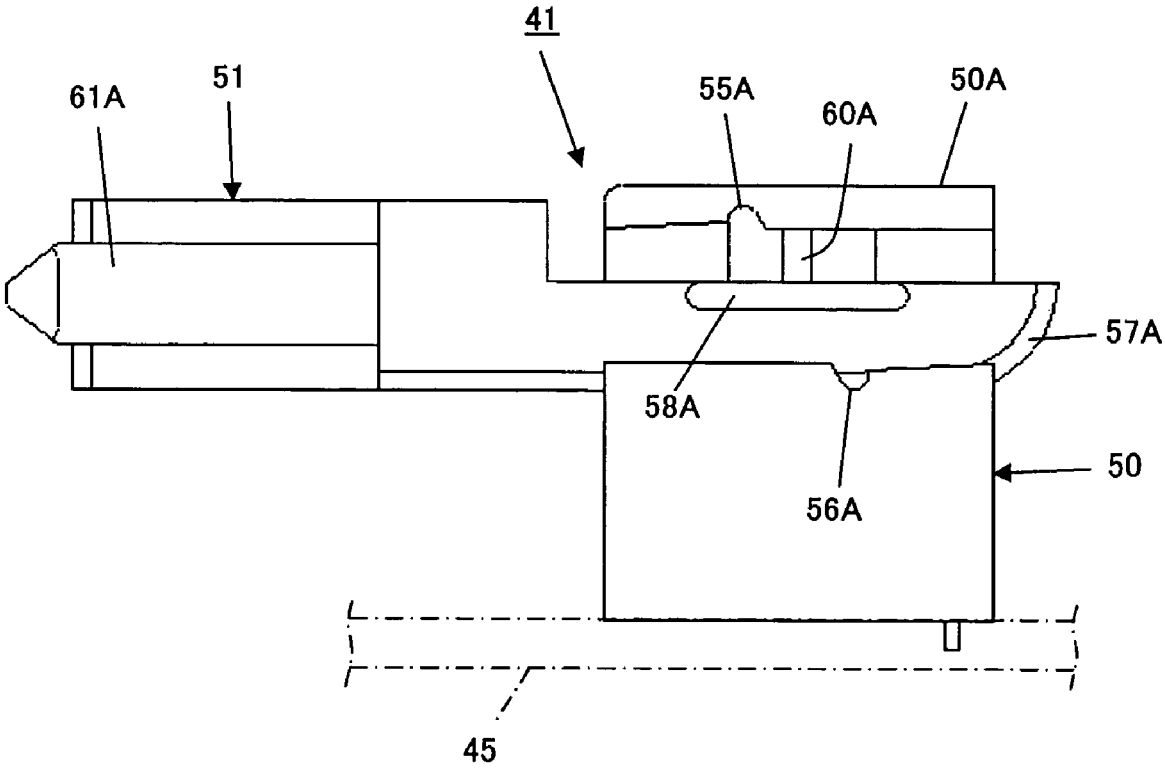
FIG. 20 is a schematic side view showing the embodiment shown in FIG. 12.
Figure 21:
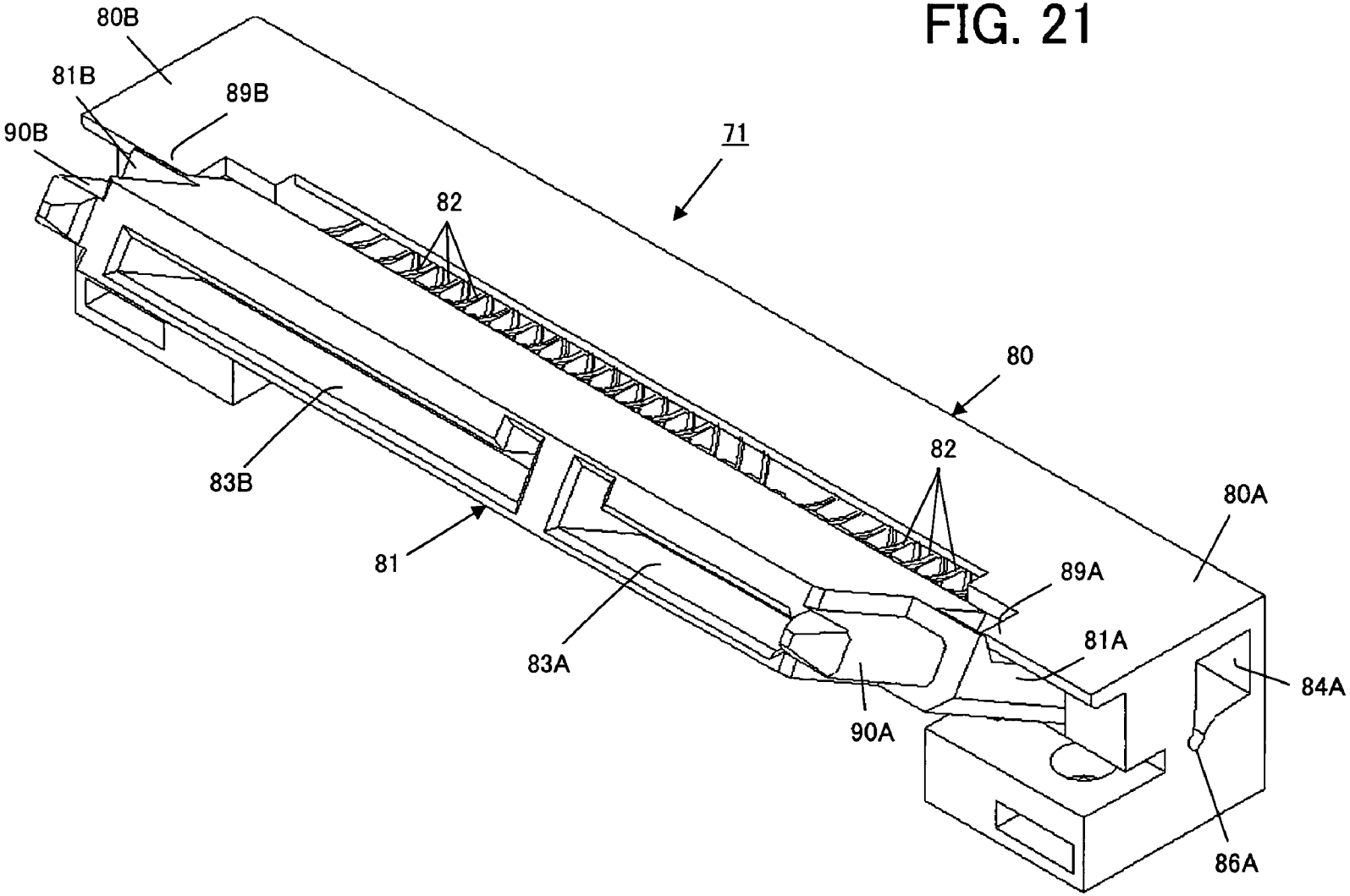
FIG. 21 is a schematic perspective view showing a further embodiment of electrical connector according to the present invention.
Figure 22:
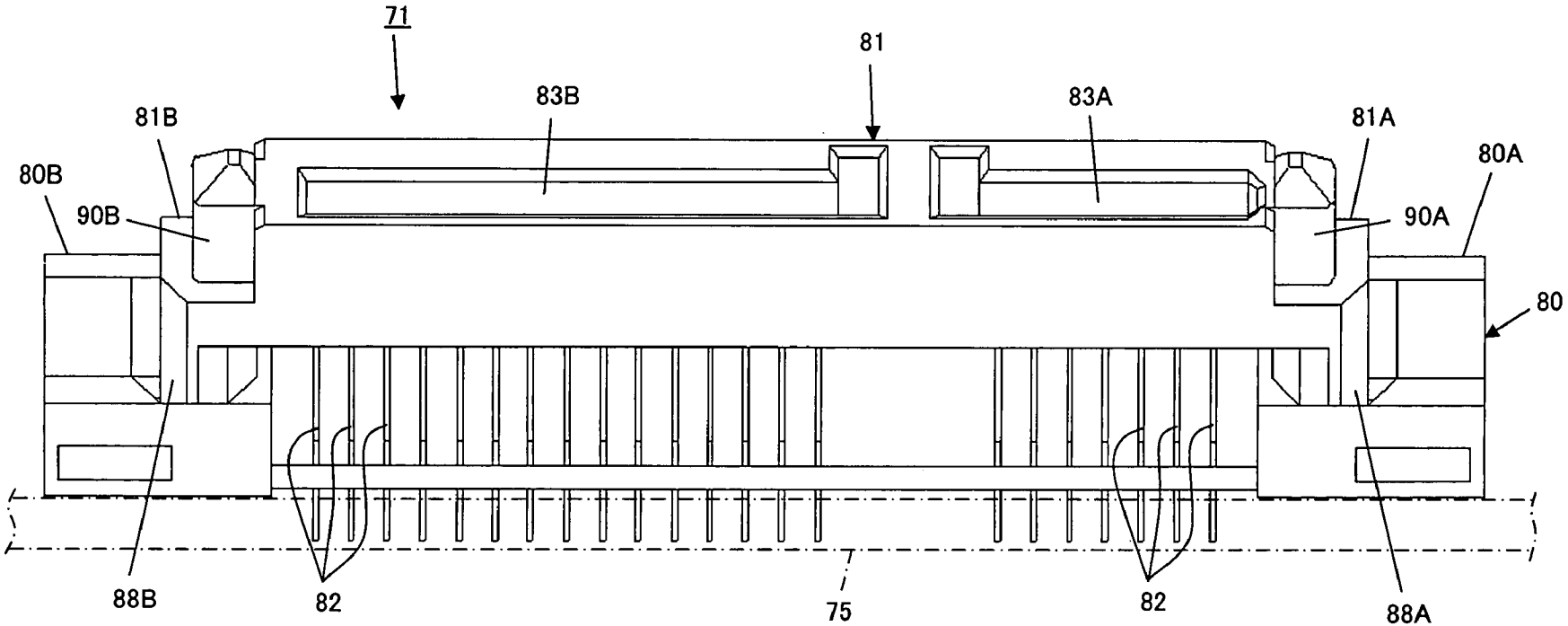
FIG. 22 is a schematic front view showing the embodiment shown in FIG. 21.
Figure 23:
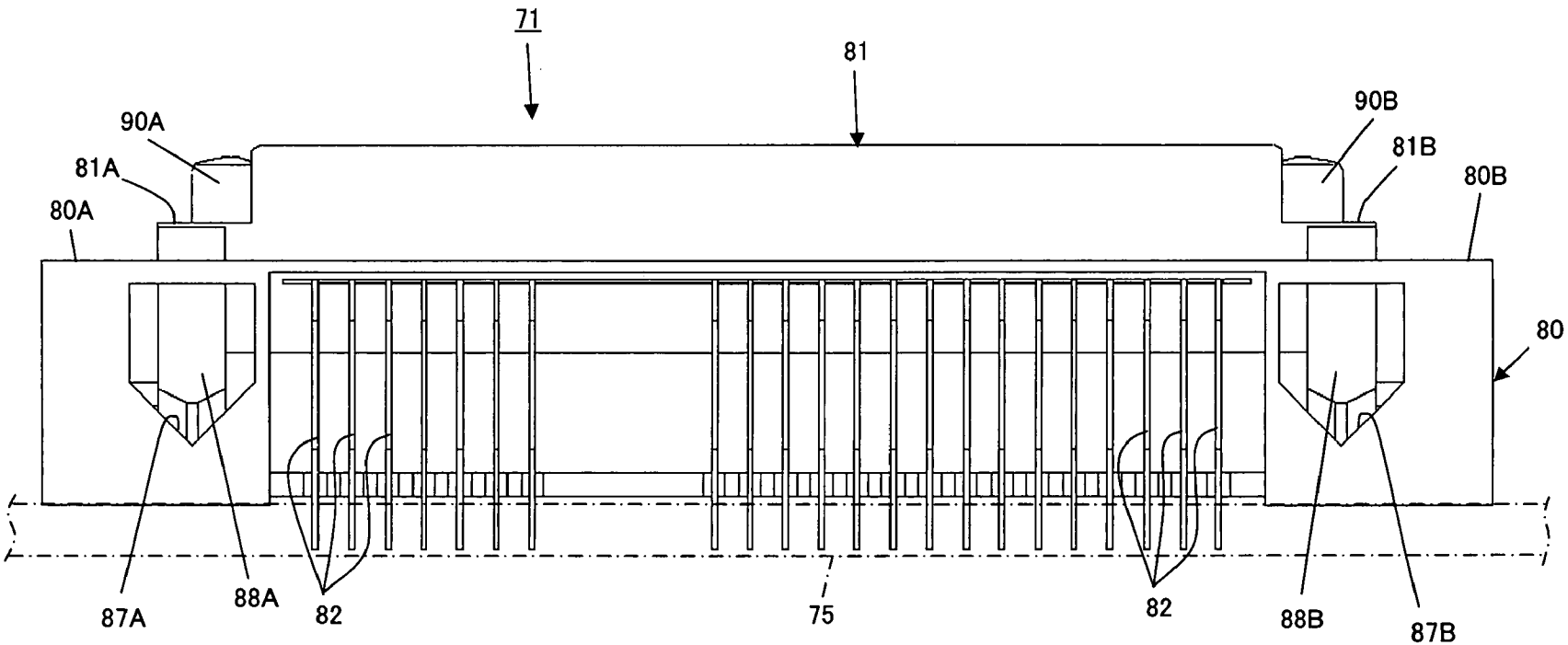
FIG. 23 is a schematic rear view showing the embodiment shown in FIG. 21.

A movable range in the Y direction of the movable housing 51 is determined by a movable range in the Y direction of the board-shaped contacting portion 60A provided on the movable housing 51 between the contacting surface 59A provided on the fixed housing 50 and a contacting surface 62A provided on the fixed housing 50 to be opposite to the contacting surface 59A (or a movable range in the Y direction of the board-shaped contacting portion 60B provided on the movable housing 51 between the contacting surface 59B provided on the fixed housing 50 and a contacting surface 62B provided on the fixed housing 50 to be opposite to the contacting surface 59B), as understandable on FIG. 19. The maximum moving distance in the Y direction of the board-shaped contacting portion 60A between the contacting surface 59A and the contacting surface 62A is the sum of two distances Y11 and Y12 shown in FIG. 19, namely, Y11+Y12. Accordingly, the maximum moving distance in the Y direction of the movable housing 51 is Y11+Y12, so that the movable range in the Y direction of the movable housing 51 is set to be within the maximum distance Y11+Y12.

Figure 17:
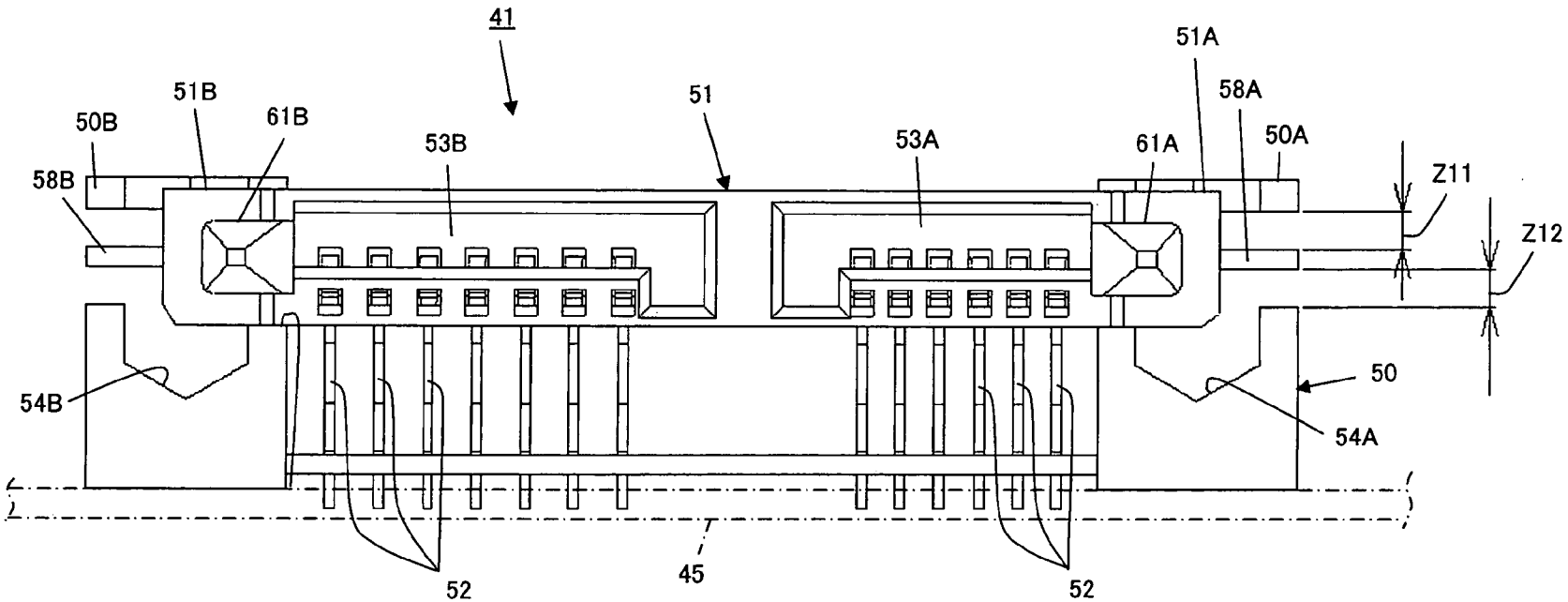
FIG. 17 is a schematic front view showing the embodiment shown in FIG. 12.

A movable range in the Z direction of a part of the movable housing 51 on which the board-shaped engaging portions 58A and 58B are provided is determined by a movable range in the Z direction of the board-shaped engaging portions 58A provided on the movable housing 51 between a part of the fixed housing 50 on which the engaging groove 55A is provided and a part of the fixed housing 50 on which the engaging groove 56A is provided (or a movable range in the Z direction of the board-shaped engaging portions 58B provided on the movable housing 51 between a part of the fixed housing 50 on which the engaging groove 55B is provided and a part of the fixed housing 50 on which the engaging groove 56B is provided), as understandable on FIG. 17. A movable range in the Z direction of each of the contacting portions 57A and 57B provided on the movable housing 51 is determined by a movable range in the Z direction of the contacting portion 57A in the V-shaped guiding groove 54A and at the outside of the V-shaped guiding groove 54A (or a movable range in the Z direction of the contacting portion 57B in the V-shaped guiding groove 54B and at the outside of the V-shaped guiding groove 54B), as understandable on FIG. 18.

The maximum moving distance in the Z direction of the board-shaped engaging portion 58A between the part of the fixed housing 50 on which the engaging groove 55A is provided and the part of the fixed housing 50 on which the engaging groove 56A is provided is the sum of two distances Z11 and Z12 shown in FIG. 17, namely, Z11+Z12. Accordingly, the maximum moving distance in the Z direction of the part of the movable housing 51 on which the board-shaped engaging portions 58A and 58B are provided is Z11+Z12, so that the movable range in the Y direction of the part of the movable housing 51 on which the board-shaped engaging portions 58A and 58B are provided is set to be within the maximum distance Z11+Z12. The maximum moving distance in the Z direction of the contacting portion 57A in the V-shaped guiding groove 54A and at the outside of the V-shaped guiding groove 54A is the sum of two distances Z13 and Z14 shown in FIG. 18, namely, Z13+Z14. Accordingly, the maximum moving distance in the Z direction of each of the contacting portions 57A and 57B provided on the movable housing 51 is Z13+Z14, so that the movable range in the Z direction of each of the contacting portions 57A and 57B provided on the movable housing 51 is set to be within the maximum distance Z13+Z14.

FIGS. 21 to 24 show a further embodiment of electrical connector according to the present invention, which is put in one of selectable states.

Referring to FIGS. 21 to 24, an electrical connector 71, which constitutes one of the embodiments of electrical connector according to the present invention, has a fixed housing 80 made of insulator such as plastics or the like and attached to a circuit board 75 such as a solid printed circuit board or the like and a movable housing 81 also made of insulator such as plastics or the like. The movable housing 81 is coupled with the fixed housing 80 through a plurality of conductive contacts 82 arranged along a predetermined direction. Each of the conductive contacts 82 is made of conductive resilient material such as metallic material, and a first portion of each of the conductive contacts 82 is connected with a circuit terminal on the circuit board 75. The conductive contacts 82 thus arranged are operative to force the movable housing 81 to keep away from the fixed housing 80.

In the movable housing 81, connecting hollows 83A and 83B which have respective openings formed on a front end portion of the movable housing 81 and in which a counterpart electrical connector provided on, for example, a hard disc drive is inserted are provided. A second portion of each of the conductive contacts 82, the first portion of which is connected with a circuit terminal on the circuit board 75, is positioned in the connecting hollow 83A or 83B for coming into press-contact with a connecting terminal provided on the counterpart electrical connector. Thereby, the counterpart electrical connector inserted in the connecting hollows 83A and 83B is electrically connected through the conductive contacts 82 with the circuit board 75.

A first engaging mechanism comprises one end portion 80A of the fixed housing 80 in the direction along which the conductive contacts 82 are arranged and one end portion 81A of the movable housing 81 which corresponds to the end portion 80A of the fixed housing 80. Further, a second engaging mechanism comprises the other end portion 80B of the fixed housing 80 in the direction along which the conductive contacts 82 are arranged and the other end portion 81B of the movable housing 81 which corresponds to the end portion 80B of the fixed housing 80.

The first and second engaging mechanisms thus constituted are operative to put the movable housing 81 selectively in a locked state (a first state) in which the movable housing 81 is temporarily fixed to the fixed housing 80 and takes a first posture with which an inserting direction of the counterpart electrical connector to the connecting hollows 83A and 83B is angled to the circuit board 75, as shown in FIGS. 21 to 24, and in a floating state (a second state) in which the movable housing 81 is able to move freely to the fixed housing 80 in a predetermined range and takes a second posture with which the inserting direction of the counterpart electrical connector to the connecting hollows 83A and 83B is in substantially parallel with the circuit board 75. The first and second engaging mechanisms are further operative to allow the movable housing 81 to rotate to the fixed housing 80 so that the inserting direction of the counterpart electrical connector to the connecting hollows 83A and 83B varies in its angle to the circuit board 75.

Figure 24:
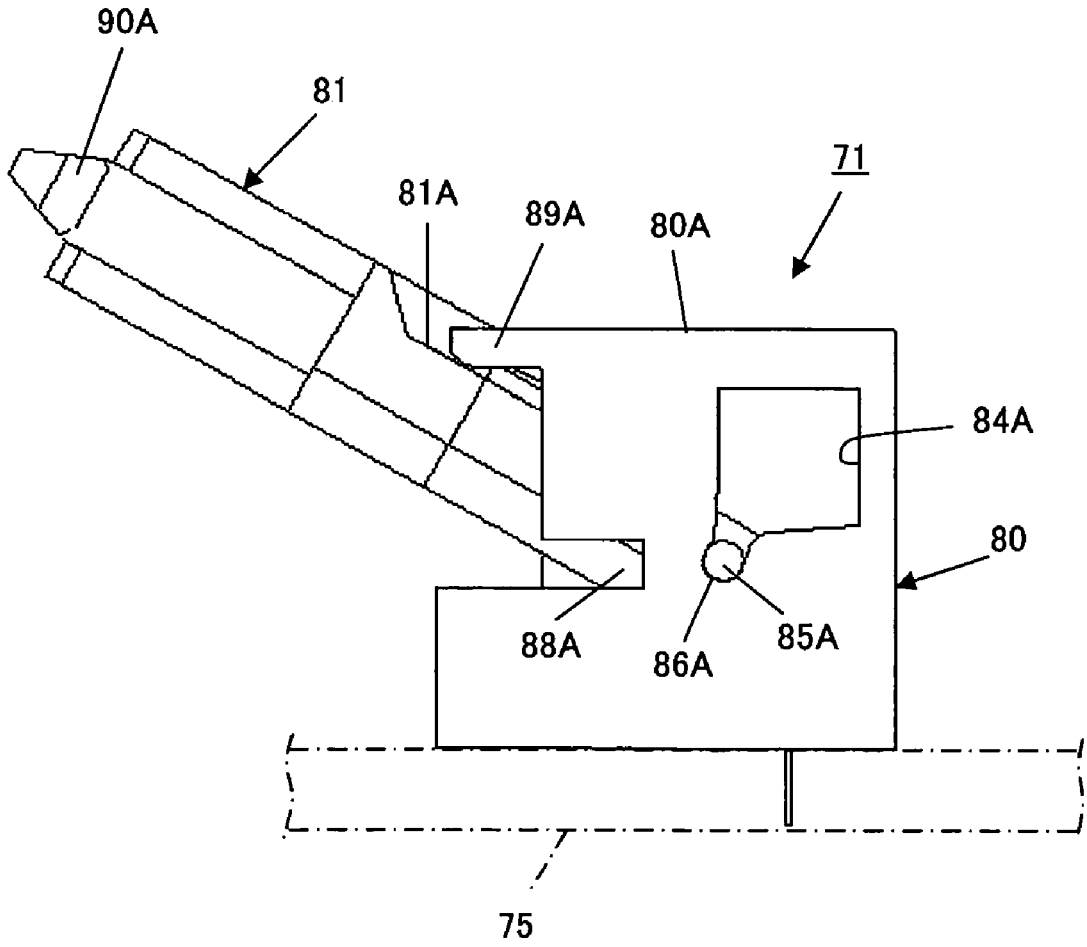
FIG. 24 is a schematic side view showing the embodiment shown in FIG. 21.
Figure 25:
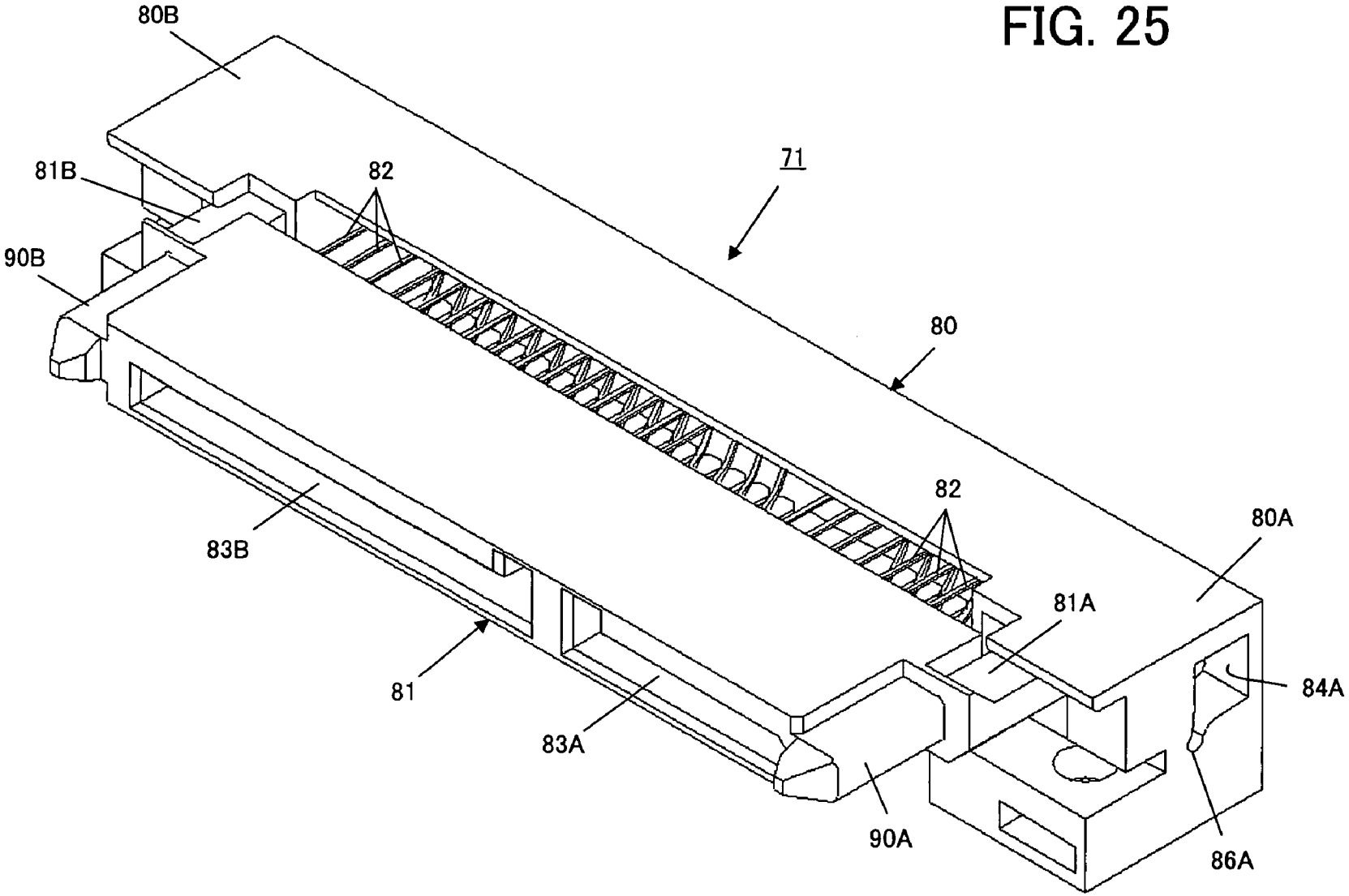
FIG. 25 is a schematic perspective view showing the embodiment shown in FIG. 21.
Figure 26:
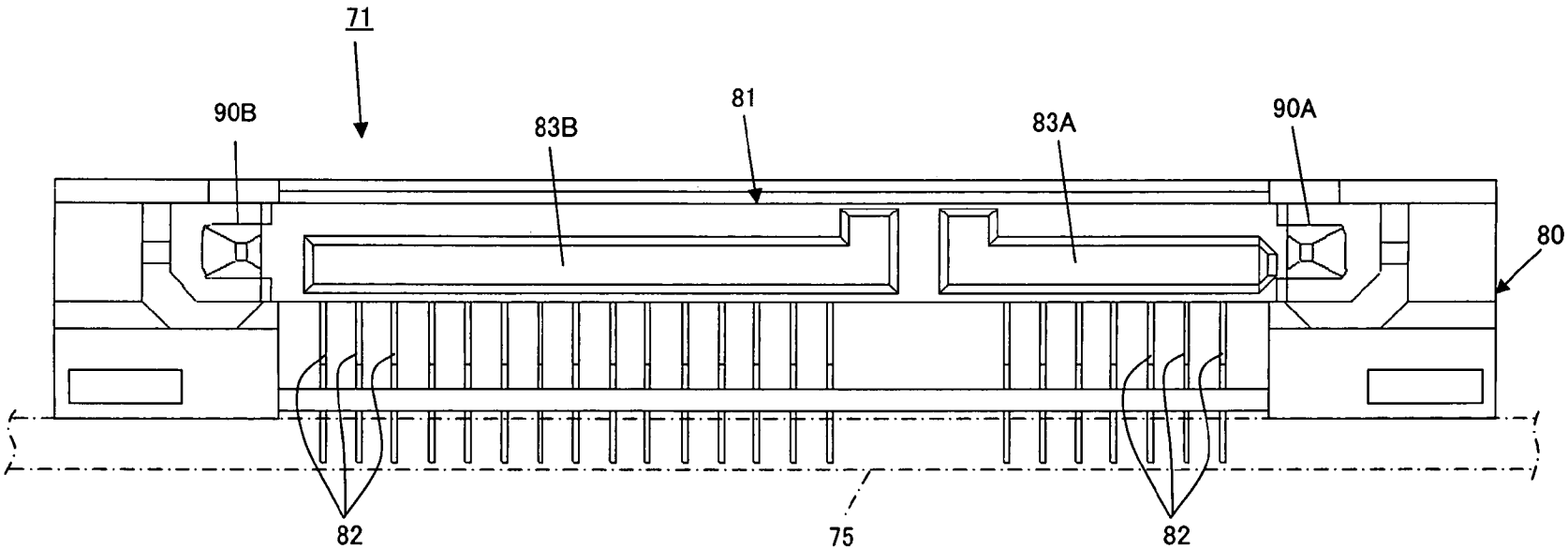
FIG. 26 is a schematic front view showing the embodiment shown in FIG. 21.

The first engaging mechanism comprising the end portion 80A of the fixed housing 80 and the end portion 81A of the movable housing 81 includes a first locking mechanism which comprises a guiding hole 84A provided on the end portion 80A and an engaging projection 85A provided on the end portion 81A, as shown in FIG. 24. In the first locking mechanism, the guiding hole 84A has an engaging cutout portion 86A and the engaging projection 85A is operative to move toward the circuit board 75 for engaging with the engaging cutout portion 86A, as shown in FIG. 24.

The first engaging mechanism further comprises a guiding hole 87A having a V-shaped guiding groove and provided on the end portion 80A of the fixed housing 80 and a contacting portion 88A provided on the end portion 81A of the movable housing 81 for coming into contact with the V-shaped guiding groove of the guiding hole 87A to be guided by the same. The contacting portion 88A has a V-shaped edge corresponding to the guiding hole 87A.

The second engaging mechanism comprising the end portion 80B of the fixed housing 80 and the end portion 81B of the movable housing 81 is constituted in the same manner as the first engaging mechanism. That is, the second engaging mechanism includes a second locking mechanism corresponding to the first locking mechanism and the second locking mechanism comprises a guiding hole, an engaging projection and an engaging cutout portion, which do not appear on the drawings and correspond to the guiding hole 84A, the engaging projection 85A and the engaging cutout portion 86A, respectively, a guiding hole 87B corresponding to the guiding hole 87A, and a contacting portion 88B corresponding to the contacting portion 88A.

When the engaging projection 85A engages with the engaging cutout portion 86A and the contacting portion 88A comes into contact with the V-shaped guiding groove of the guiding hole 87A to be guided by the same in the first locking mechanism and the engaging projection 85A engages with the engaging cutout portion 86A and the contacting portion 88B comes into contact with the V-shaped guiding groove of the guiding hole 87B to be guided by the same in the second locking mechanism, the movable housing 81 is temporary fixed to the fixed housing 80 and takes the first posture with which the inserting direction of the counterpart electrical connector to the connecting hollows 83A and 83B slants at an angle of, for example, about 30 degrees to the circuit board 75, as shown in FIGS. 21 to 24. At that time, the end portion 81A of the movable housing 81 comes into contact with a contacting portion 89A provided on the fixed housing 80 and a part of the end portion 81B of the movable housing 81 comes into contact with a contacting portion 89B provided on the fixed housing 80, so that the movable housing 81 is positioned by the contacting portions 89A and 88B.

In a fixation of the movable housing 81 to the fixed housing 80 thus conducted, the angle to the circuit board 75 of the inserting direction of the counterpart electrical connector to the connecting hollows 83A and 83B can be optionally set by varying partial shapes of the fixed and movable housings 80 and 81. Further, the contacting portions 88A and 88B provided on the movable housing 81 to have the respective V-shaped edges are guided by the V-shaped guiding grooves of the guiding holes 87A and 87B provided on the fixed housing 80, respectively, and therefore the movable housing 81 is stably positioned in relation to the fixed housing 80 at a predetermined position in the direction along which the conductive contacts 82 are arranged.

A couple of post-shaped portions 90A and 90B provided on the movable housing 81, between which the openings of the connecting hollows 83A and 83B are put, are operative to guide the counterpart electrical connector inserted in the connecting hollows 83A and 83B.

The counterpart electrical connector is inserted in the connecting hollows 83A and 83B when the movable housing 81 is temporary fixed to the fixed housing 80 and takes the first posture with which the inserting direction of the counterpart electrical connector to the connecting hollows 83A and 83B slants at the angle of, for example, about 30 degrees to the circuit board 75, as shown in FIGS. 21 to 24. At that time, a couple of portions of the counterpart electrical connector engage with the post-shaped portions 90A and 90B, respectively, to be guided by the same so that the counterpart electrical connector is smoothly inserted in the connecting hollows 83A and 83B.

In the insertion of the counterpart electrical connector in the connecting hollows 83A and 83B thus conducted, the inserting direction of the counterpart electrical connector to the connecting hollows 83A and 83B is set to be at the angle of, for example, about 30 degrees to the circuit board 75 and therefore the counterpart electrical connector is not required to be moved in parallel with the circuit board 75, and in addition, the movable housing 81 is fixed to the fixed housing 80 so that the connecting hollows 83A and 83B do not move. Consequently, the counterpart electrical connector can be easily and surely inserted in the connecting hollows 83A and 83B provided in the movable housing 81 with simple and easy operations.

After the counterpart electrical connector has been inserted in the connecting hollows 83A and 83B provided in the movable housing 81, the movable housing 81 is rotated to the fixed housing 80 so that the inserting direction of the counterpart electrical connector to the connecting hollows 83A and 83B varies in angle to the circuit board 75. In this situation, in the first locking mechanism which is included in the first engaging mechanism comprising the end portion 80A of the fixed housing 80 and the end portion 81A of the movable housing 81, the engaging projection 85A is released from the engagement with the engaging cutout portion 86A and the contacting portion 88A is released from the guidance by the guiding hole 87A, and in the second locking mechanism which is included in the second engaging mechanism comprising the end portion 80B of the fixed housing 80 and the end portion 81B of the movable housing 81, the engaging projection is released from the engagement with the engaging cutout portion and the contacting portion 88B is released from the guidance by the guiding hole 87B.

Then, the movable housing 81 is put in the floating state in which the movable housing 81 is able to move freely to the fixed housing 80 in the predetermined range and takes the second posture with which the insertion direction of the counterpart electrical connector to the connecting hollows 83A and 83B is in substantially parallel with the circuit board 75, as shown in FIGS. 25 to 28. The counterpart electrical connector is omitted to be shown in each of FIGS. 25 to 28.

When the movable housing 81 is put in the floating state in which the movable housing 81 is able to move freely to the fixed housing 80 in the predetermined range and takes the second posture with which the insertion direction of the counterpart electrical connector to the connecting hollows 83A and 83B is in substantially parallel with the circuit board 75, in the first locking mechanism which is included in the first engaging mechanism comprising the end portion 80A of the fixed housing 80 and the end portion 81A of the movable housing 81, the engaging projection 85A is released from the engagement with the engaging cutout portion 86A to be at a small distance from the same and the contacting portion 88A is also released from the guidance by the V-shaped guiding groove of the guiding hole 87A, and similarly, in the second locking mechanism which is included in the second engaging mechanism comprising the end portion 80B of the fixed housing 80 and the end portion 81B of the movable housing 81, the engaging projection is released from the engagement with the engaging cutout portion to be at a small distance from the same and the contacting portion 88B is also released from the guidance by the V-shaped guiding groove of the guiding hole 87B.

Thereby, the movable housing 81 is supported only by the conductive contacts 82 arranged along the predetermined direction with the respective first portions connected with the circuit terminals on the circuit board 75, so that the movable housing 81 accompanied with the counterpart electrical connector is able to move freely to the fixed housing 80 in the predetermined range and takes the second posture with which the insertion direction of the counterpart electrical connector to the connecting hollows 83A and 83B is in substantially parallel with the circuit board 75. As a result, vibrations and shocks acting on an apparatus or device, such as the hard disc drive, on which the counterpart electrical connector is provided are absorbed by the movable housing 81 so that the apparatus or device on which the counterpart electrical connector is provided is protected against the vibrations and shocks acting thereon.

In the case of the electrical connector 71 thus constituted also, assuming that the direction along which the conductive contacts 82 are arranged is referred to as an X direction, a direction in parallel with the circuit board 75 and perpendicular to the X direction is referred to as a Y direction and a direction perpendicular to the circuit board 75 is referred to as a Z direction, the movable housing 81 accompanied with the counterpart electrical connector and put in the floating state moves in the X, Y and Z directions in such a manner as described below.

Figure 27:
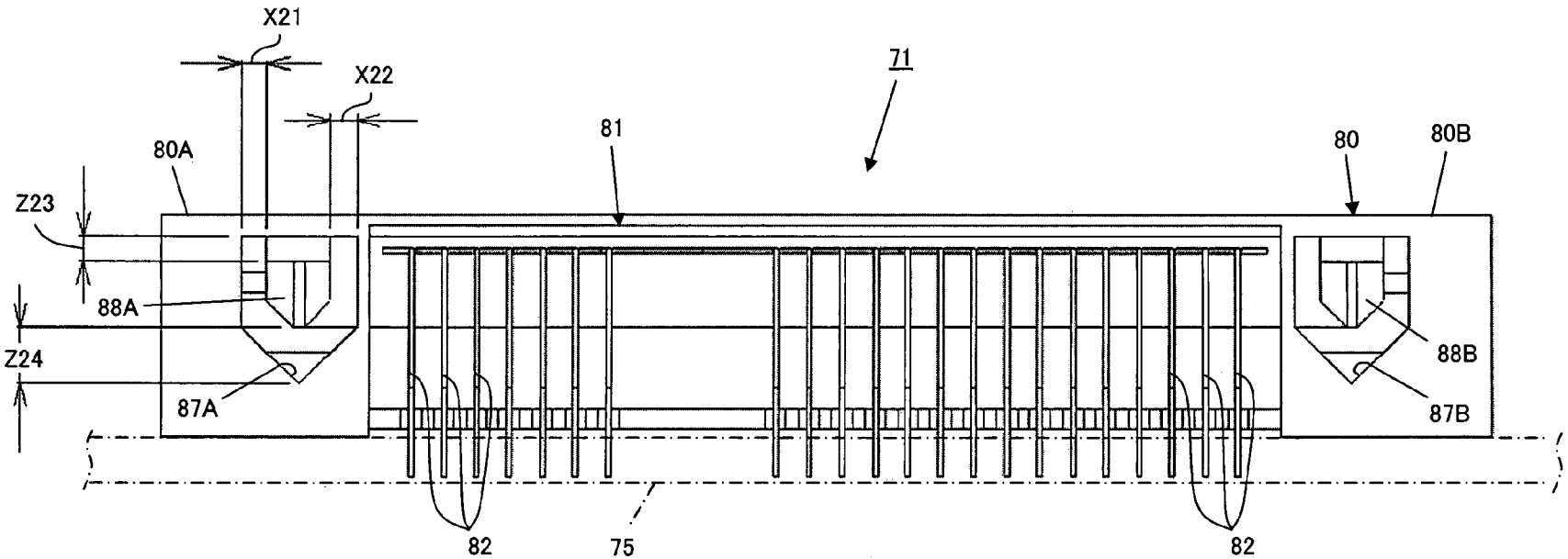
FIG. 27 is a schematic rear view showing the embodiment shown in FIG. 21.

A movable range in the X direction of the movable housing 81 is determined by a movable range in the X direction of the contacting portion 88A provided on the movable housing 81 in the guiding hole 87A having the V-shaped guiding groove provided on the fixed housing 80 (or a movable range in the X direction of the contacting portion 88B provided on the movable housing 81 in the guiding hole 87B having the V-shaped guiding groove provided on the fixed housing 80), as understandable on FIG. 27. The maximum moving distance in the X direction of the contacting portion 88A in the guiding hole 87A having the V-shaped guiding grooves is the sum of two distances X21 and X22 shown in FIG. 27, namely, X21+X22. Accordingly, the maximum moving distance in the X direction of the movable housing 81 is X21+X22, so that the movable range in the X direction of the movable housing 81 is set to be within the maximum distance X21+X22.

Figure 28:
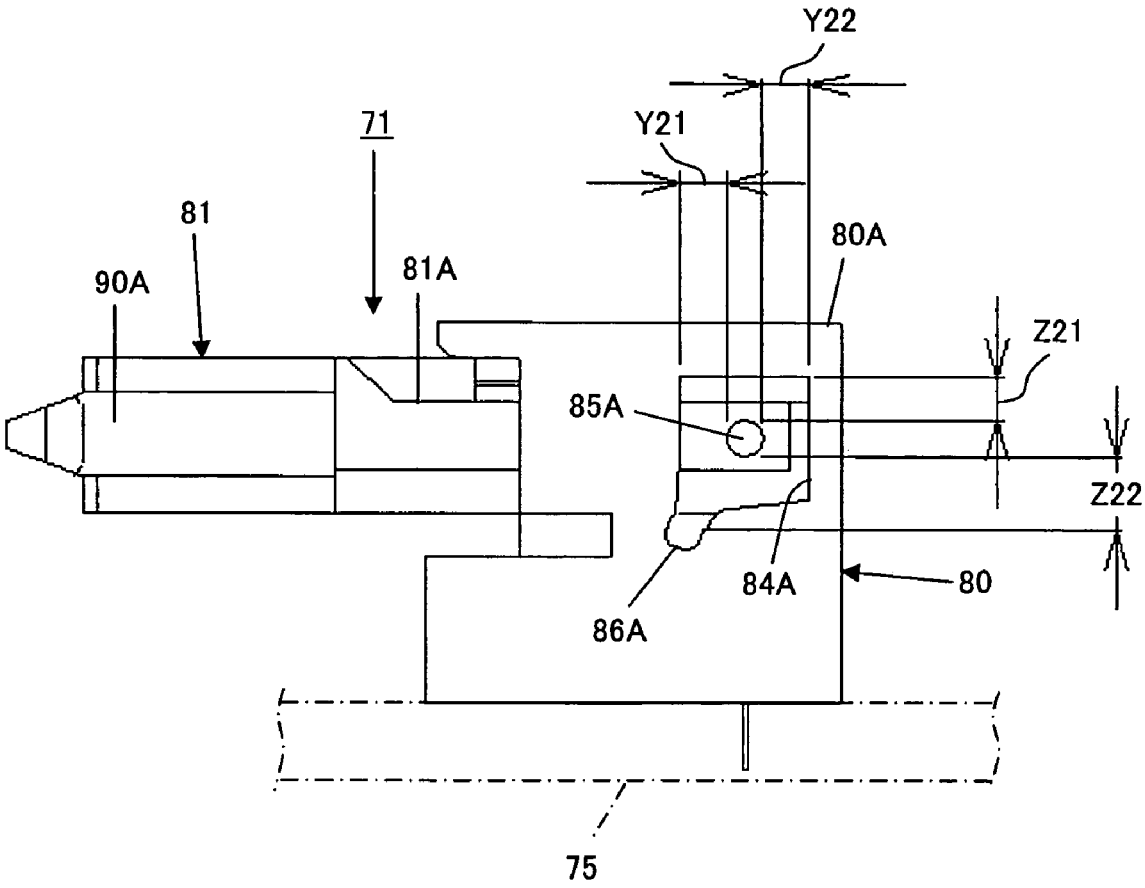
FIG. 28 is a schematic side view showing the embodiment shown in FIG. 21.

A movable range in the Y direction of the movable housing 81 is determined by a movable range in the Y direction of the engaging projection 85A provided on the movable housing 81 in the guiding hole 84A provided on the fixed housing 80 (or a movable range in the Y direction of the engaging projection provided on the end portion 81B of the movable housing 81 in the guiding hole provided on the end portion 80B of the fixed housing 80), as understandable on FIG. 28. The maximum moving distance in the Y direction of the engaging projection in the guiding hole is the sum of two distances Y21 and Y22 shown in FIG. 28, namely, Y21+Y22. Accordingly, the maximum moving distance in the Y direction of the movable housing 81 is Y21+Y22, so that the movable range in the Y direction of the movable housing 81 is set to be within the maximum distance Y21+Y22.

A movable range in the Z direction of the movable housing 81 is determined by a movable range in the Z direction of the engaging projection 85A provided on the movable housing 81 in the guiding hole 84A provided on the fixed housing 80 (or a movable range in the Z direction of the engaging projection provided on the end portion 81B of the movable housing 81 in the guiding hole provided on the end portion 80B of the fixed housing 80), as understandable on FIG. 28, and a movable range in the Z direction of each of the contacting portions 88A and 88B provided on the movable housing 81 is determined by a movable range in the Z direction of the contacting portions 88A in the guiding hole 87A having the V-shaped guiding groove (or a movable range in the Z direction of the contacting portions 88B in the guiding hole 87B having the V-shaped guiding groove).

The maximum moving distance in the Z direction of the engaging projection 85A in the guiding hole 84A is the sum of two distances Z21 and Z22 shown in FIG. 28, namely, Z21+Z22. Accordingly, the maximum moving distance in the Z direction of the movable housing 81 is Z21+Z22, so that the movable range in the Z direction of the movable housing 81 is set to be within the maximum distance Z21+Z22. Further, the maximum moving distance in the Z direction of the contacting portion 88A in the guiding hole 87A having the V-shaped guiding groove is the sum of two distances Z23 and Z24 shown in FIG. 27, namely, Z23+Z24 Accordingly, the maximum moving distance in the Z direction of each of the contacting portions 88A and 88B is Z23+Z24, so that the movable range in the Z direction of each of the contacting portions 88A and 88B is set to be within the maximum distance Z23+Z24.

Figure 29:
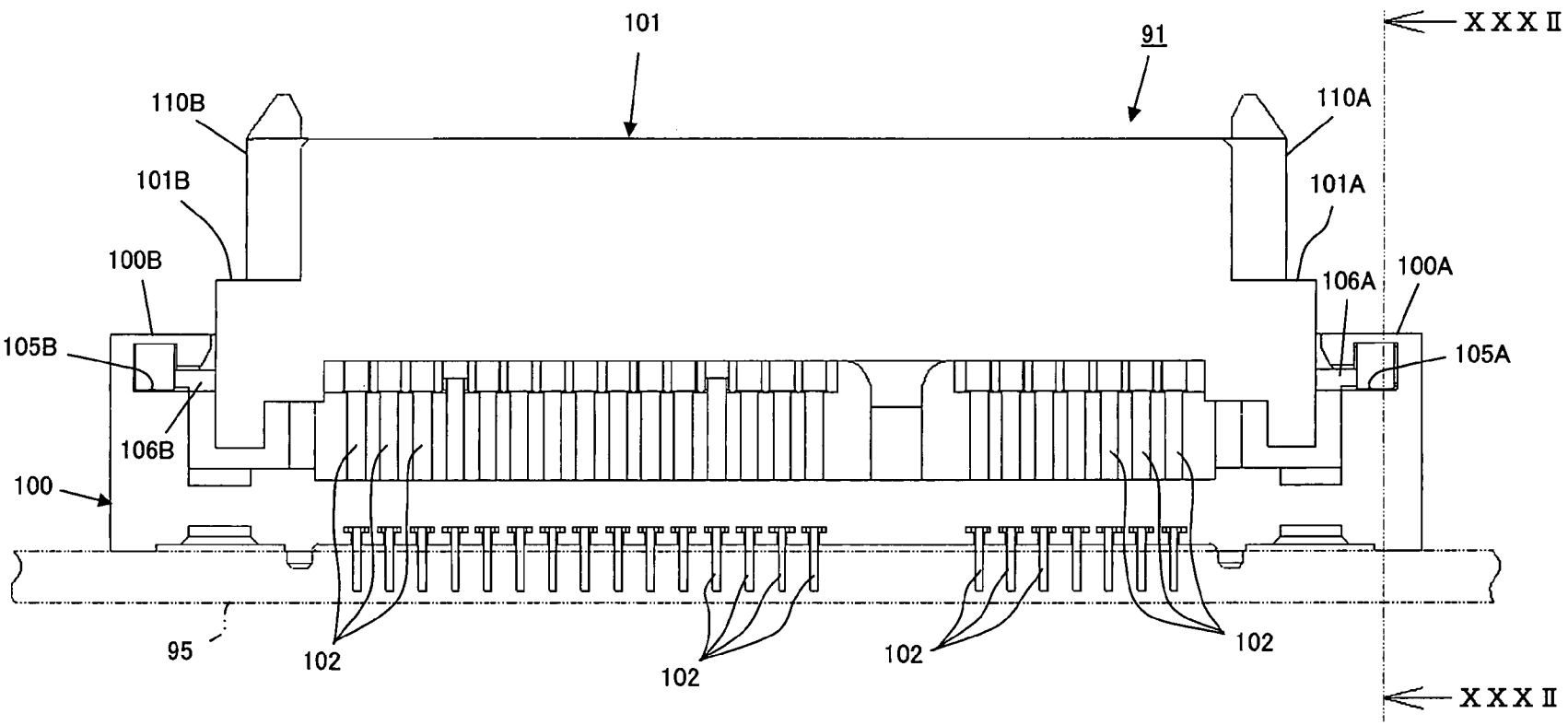
FIG. 29 is a schematic front view showing a still further embodiment of electrical connector according to the present invention.
Figure 30:
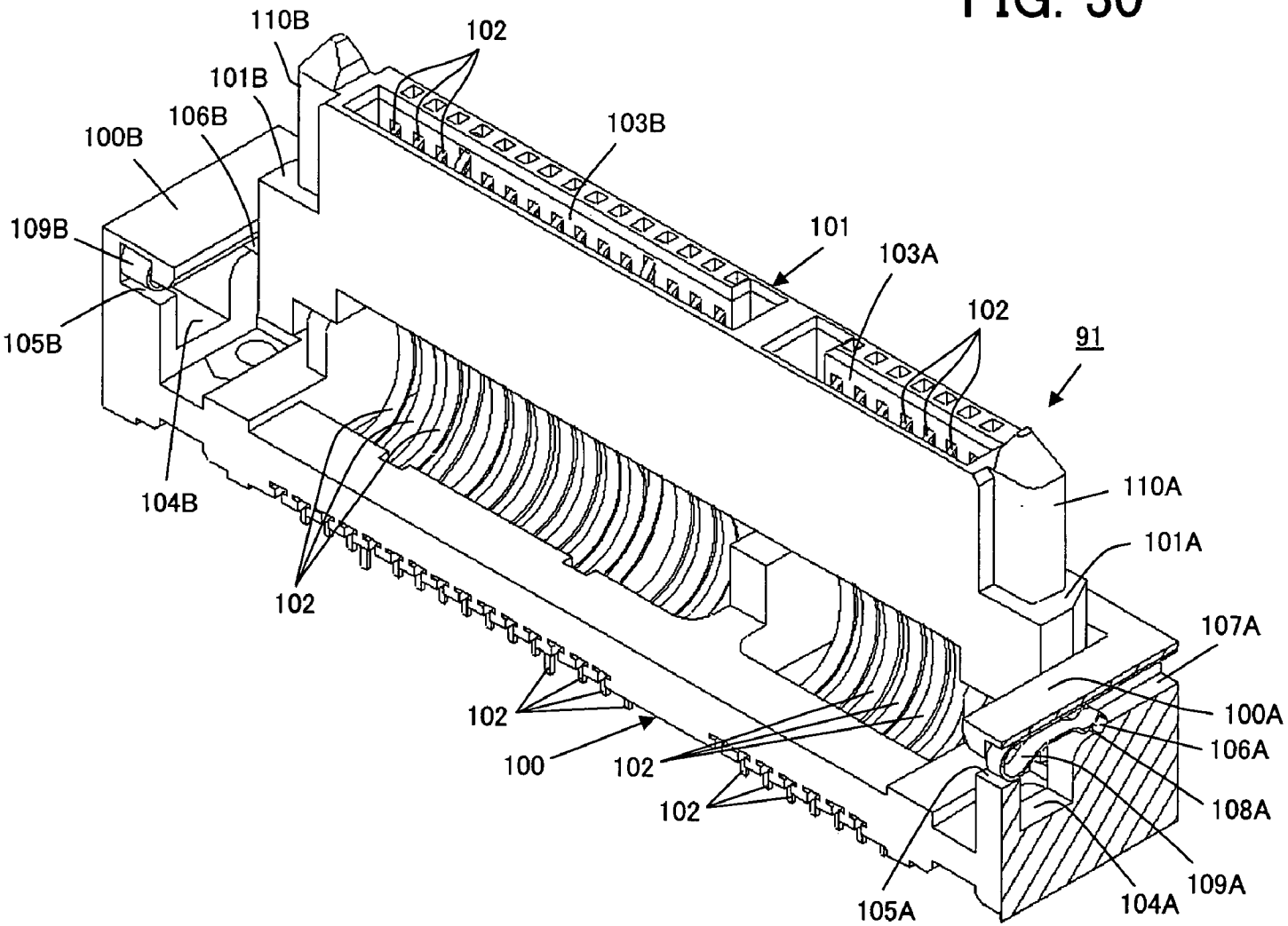
FIG. 30 is a schematic perspective view showing the embodiment shown in FIG. 29.
Figure 31:
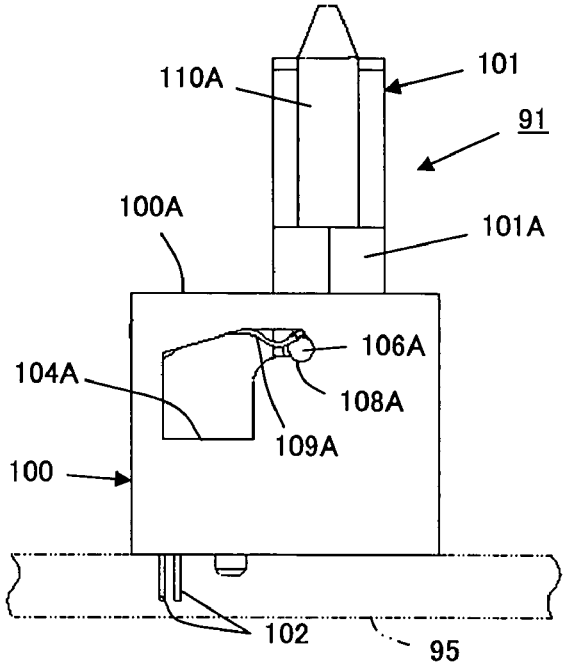
FIG. 31 is a schematic side view showing the embodiment shown in FIG. 29.

FIGS. 29 to 31 show a still further embodiment of electrical connector according to the present invention, which is put in one of selectable states.

Referring to FIGS. 29 to 31, an electrical connector 91, which constitutes one of the embodiments of electrical connector according to the present invention, has a fixed housing 100 made of insulator such as plastics or the like and attached to a circuit board 95 such as a solid printed circuit board or the like and a movable housing 101 also made of insulator such as plastics or the like. The movable housing 101 is coupled with the fixed housing 100 through a plurality of conductive contacts 102 arranged along a predetermined direction. Each of the conductive contacts 102 is made of conductive resilient material such as metallic material, and a first portion of each of the conductive contacts 102 is connected with a circuit terminal on the circuit board 95. The conductive contacts 102 thus arranged are operative to force the movable housing 101 to keep away from the fixed housing 100.

In the movable housing 101, connecting hollows 103A and 103B which have respective openings formed on a front end portion of the movable housing 101 and in which a counterpart electrical connector provided on, for example, a hard disc drive is inserted are provided. A second portion of each of the conductive contacts 102, the first portion of which is connected with a circuit terminal on the circuit board 95, is positioned in the connecting hollows 103A or 103B for coming into press-contact with a connecting terminal provided on the counterpart electrical connector. Thereby, the counterpart electrical connector inserted in the connecting hollows 103A and 103B is electrically connected through the conductive contacts 102 with the circuit board 95.

A first engaging mechanism comprises one end portion 100A of the fixed housing 100 in the direction along which the conductive contacts 102 are arranged and one end portion 101A of the movable housing 101 which corresponds to the end portion 100A of the fixed housing 100. Further, a second engaging mechanism comprises the other end portion 100B of the fixed housing 100 in the direction along which the conductive contacts 102 are arranged and the other end portion 101B of the movable housing 101 which corresponds to the end portion 100B of the fixed housing 100.

The first and second engaging mechanisms thus constituted are operative to put the movable housing 101 selectively in a locked state (a first state) in which the movable housing 101 is temporarily fixed to the fixed housing 100 and takes a first posture with which an inserting direction of the counterpart electrical connector to the connecting hollows 103A and 103B is set to be, for example, substantially perpendicular to the circuit board 95, as shown in FIGS. 29 to 31, and in a floating state (a second state) in which the movable housing 101 is able to move freely to the fixed housing 100 in a predetermined range and takes a second posture with which the inserting direction of the counterpart electrical connector to the connecting hollows 103A and 103B is in substantially parallel with the circuit board 95. The first and second engaging mechanisms are further operative to allow the movable housing 101 to rotate to the fixed housing 100 so that the inserting direction of the counterpart electrical connector to the connecting hollows 103A and 103B varies in its angle to the circuit board 95.

The first engaging mechanism comprising the end portion 100A of the fixed housing 100 and the end portion 101A of the movable housing 101 includes a guiding hole 104A provided on the end portion 100A, a slit 105A provided on the end portion 100A for connecting the guiding hole 104 with the outside of the fixed housing 100, a through hole 107A provided on the end portion 100A and leading to both of the guiding hole 104 and the slit 105A, and an engaging projection 106A provided on the end portion 101A, as shown in FIGS. 29 to 31 and FIG. 32 showing a cross section along line XXXII-XXXII in FIG. 29. The guiding hole 104A has an engaging cutout portion 108A.

Figure 32:
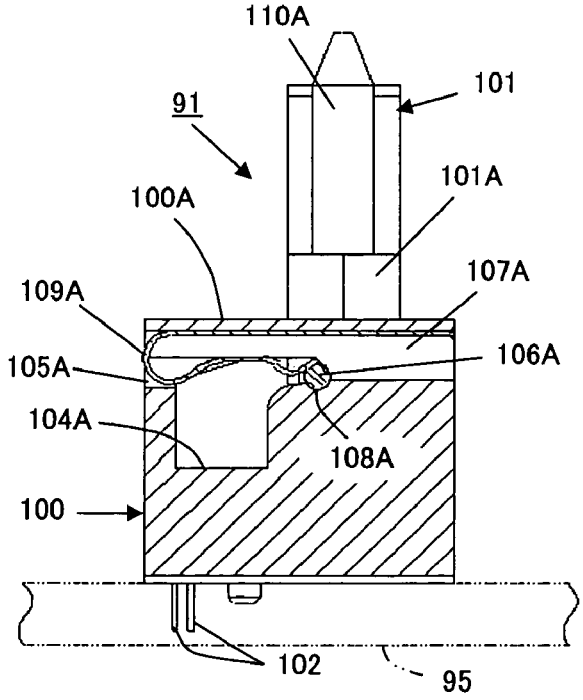
FIG. 32 is a schematic cross sectional view along line XXXII-XXXII in FIG. 29.
Figure 33:
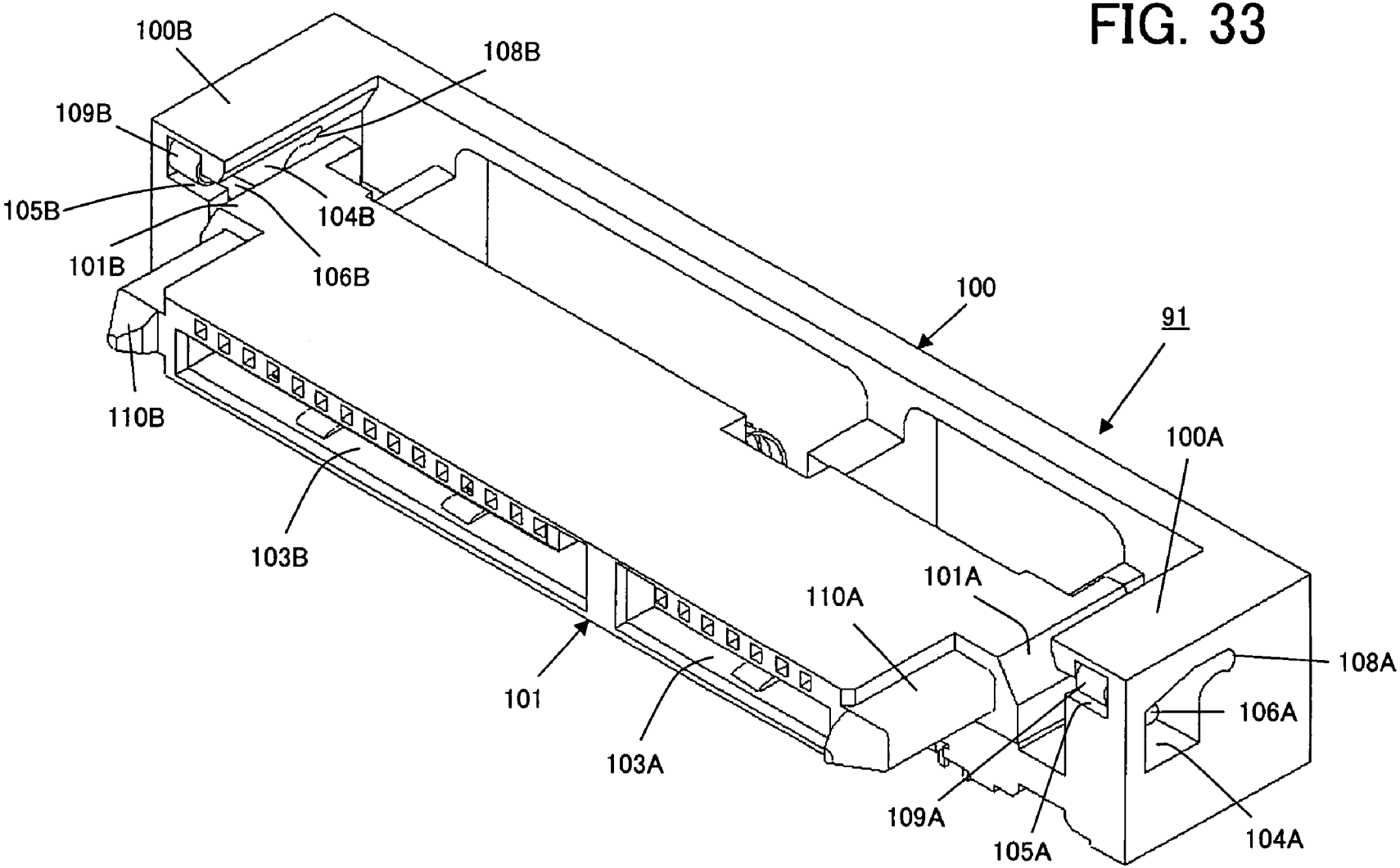
FIG. 33 is a schematic perspective view showing the embodiment shown in FIG. 29.

The engaging projection 106A provided on the end portion 101A of the movable housing 101 is operative to move into the guiding hole 104A through the slit 105A from the outside of the fixed housing 100 for engaging with the engaging cutout portion 108A, as shown in FIGS. 30 to 32. A spring member 109A is contained in the through hole 107A provided on the end portion 100A for blocking up the slit 105A and coming into press-contact with the engaging projection 106A engaging with the engaging cutout portion 108A to keep the same in its engagement with the engaging cutout portion 108A. In the first locking mechanism thus constituted, the engaging cutout portion 108A of the guiding hole 104A, the engaging projection 106A and the spring member 109A constitute a first locking mechanism for causing the movable housing 101 to take the first posture with which the inserting direction of the counterpart electrical connector to the connecting hollows 103A and 103B is set to be, for example, substantially perpendicular to the circuit board 95. The spring member 109A, which is operative to block up the slit 105A and keep the engaging projection 106A in its engagement with the engaging cutout portion 108A, is not always necessary for the first locking mechanism.

The second engaging mechanism comprising the end portion 100B of the fixed housing 100 and the end portion 101B of the movable housing 101 is constituted in the same manner as the first engaging mechanism. That is, the second engaging mechanism includes a guiding hole 104B, a slit 105B, a through hole (not shown in the drawings), a spring member 109B and an engaging projection 106B corresponding to the guiding hole 104A, the slit 105A, the through hole 107A, the spring member 109A and the engaging projection 106A, respectively. In the second engaging mechanism also, the engaging cutout portion 108B of the guiding hole 104B, the engaging projection 106B and the spring member 109B constitute a second locking mechanism for causing the movable housing 101 to take the first posture with which the inserting direction of the counterpart electrical connector to the connecting hollows 103A and 103B is set to be, for example, substantially perpendicular to the circuit board 95. The spring member 109B, which is operative to block up the slit 105B and keep the engaging projection 106B in its engagement with the engaging cutout portion 108B, is not always necessary for the second locking mechanism.

When the engaging projection 106A engages with the engaging cutout portion 108A and the spring member 109A keeps the engaging projection 106A in its engagement with the engaging cutout portion 108A in the first locking mechanism and the engaging projection 106B engages with the engaging cutout portion 108B and the spring member 109B keeps the engaging projection 106B in its engagement with the engaging cutout portion 108B in the second locking mechanism, the movable housing 101 is temporary fixed to the fixed housing 100 and takes the first posture with which the inserting direction of the counterpart electrical connector to the connecting hollows 103A and 103B is set to be, for example, substantially perpendicular to the circuit board 95, as shown in FIGS. 29 to 32.

As for such a fixation of the movable housing 101 to the fixed housing 100, the angle to the circuit board 95 of the inserting direction of the counterpart electrical connector to the connecting hollows 103A and 103B can be optionally set by varying partial shapes of the fixed and movable housings 100 and 101.

A couple of post-shaped portions 110A and 110B provided on the movable housing 101, between which the openings of the connecting hollows 103A and 103B are put, are operative to guide the counterpart electrical connector inserted in the connecting hollows 103A and 103B.

The counterpart electrical connector is inserted in the connecting hollows 103A and 103B when the movable housing 101 is temporary fixed to the fixed housing 100 and takes the first posture with which the inserting direction of the counterpart electrical connector to the connecting hollows 103A and 103B is set to be, for example, substantially perpendicular to the circuit board 95, as shown in FIGS. 29 to 32. At that time, a couple of portions of the counterpart electrical connector engage with the post-shaped portions 110A and 110B, respectively, to be guided by the same so that the counterpart electrical connector is smoothly inserted in the connecting hollows 103A and 103B.

In the insertion of the counterpart electrical connector in the connecting hollows 103A and 103B thus conducted, the inserting direction of the counterpart electrical connector to the connecting hollows 103A and 103B is set to be, for example, substantially perpendicular to the circuit board 95 and therefore the counterpart electrical connector is not required to be moved in parallel with the circuit board 95, and in addition, the movable housing 101 is fixed to the fixed housing 100 so that the connecting hollows 103A and 103B do not move. Consequently, the counterpart electrical connector can be easily and surely inserted in the connecting hollows 103A and 103B provided in the movable housing 101 with simple and easy operations.

After the counterpart electrical connector has been inserted in the connecting hollows 103A and 103B provided in the movable housing 101, the movable housing 101 is rotated to the fixed housing 100 so that the inserting direction of the counterpart electrical connector to the connecting hollows 103A and 103B varies in angle to the circuit board 95. In this situation, in the first locking mechanism which is included in the first engaging mechanism comprising the end portion 100A of the fixed housing 100 and the end portion 101A of the movable housing 101, the engaging projection 106A is released from the engagement with the engaging cutout portion 108A, and in the second locking mechanism which is included in the second engaging mechanism comprising the end portion 100B of the fixed housing 100 and the end portion 101B of the movable housing 101, the engaging projection 106B is released from the engagement with the engaging cutout portion 108B.

Figure 34:
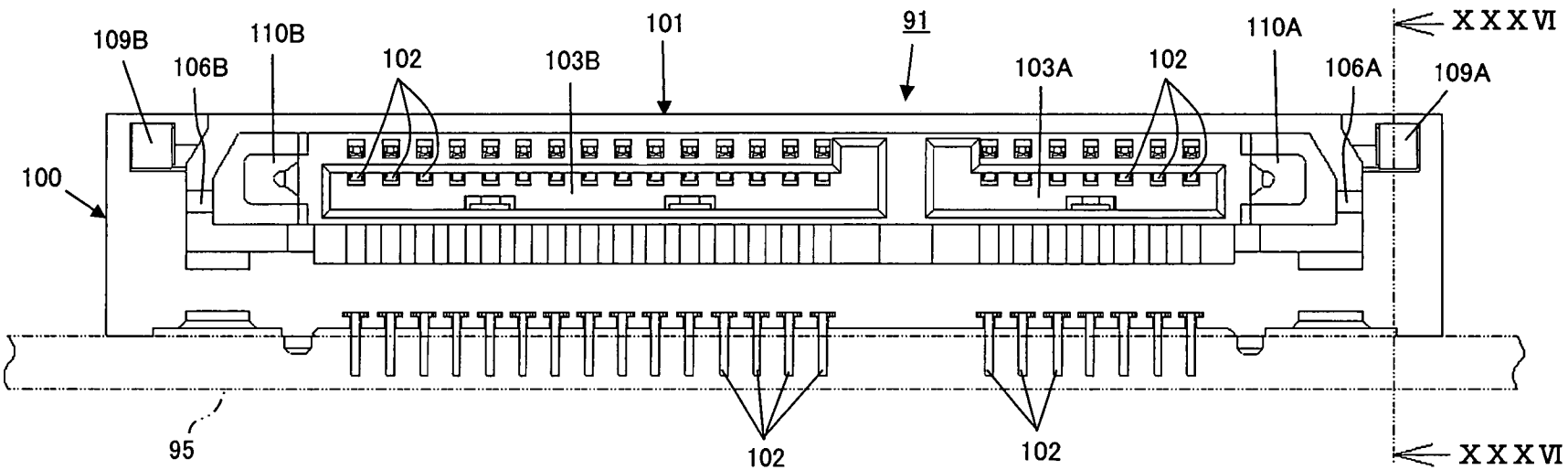
FIG. 34 is a schematic front view showing the embodiment shown in FIG. 29.
Figure 35:
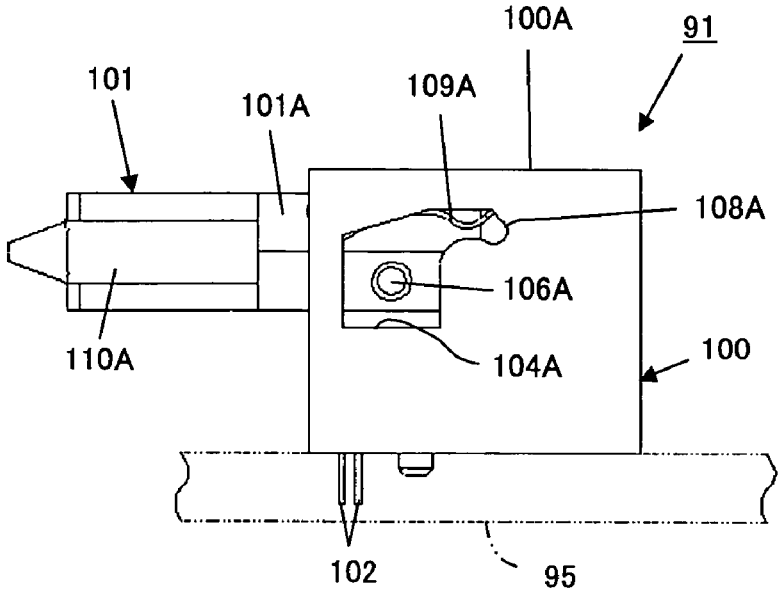
FIG. 35 is a schematic side view showing the embodiment shown in FIG. 29.
Figure 36:
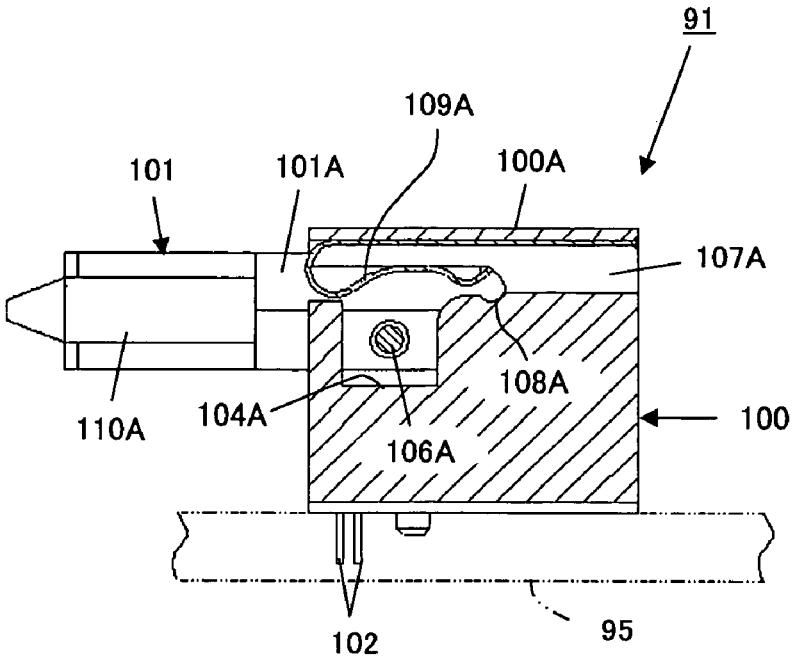
FIG. 36 is a schematic cross sectional view along line XXXVI-XXXVI in FIG. 34.

Then, the movable housing 101 is put in the floating state in which the movable housing 101 is able to move freely to the fixed housing 100 in the predetermined range and takes the second posture with which the insertion direction of the counterpart electrical connector to the connecting hollows 103A and 103B is in substantially parallel with the circuit board 95, as shown in FIGS. 33 to 35 and FIG. 36 showing a cross section along line XXXVI-XXXVI in FIG. 34. The counterpart electrical connector is omitted to be shown in each of FIGS. 33 to 36.

When the movable housing 101 is put in the floating state in which the movable housing 101 is able to move freely to the fixed housing 100 in the predetermined range and takes the second posture with which the insertion direction of the counterpart electrical connector to the connecting hollows 103A and 103B is in substantially parallel with the circuit board 95, in the first locking mechanism which is included in the first engaging mechanism comprising the end portion 100A of the fixed housing 100 and the end portion 101A of the movable housing 101, the engaging projection 106A is released from the engagement with the engaging cutout portion 108A to be at a small distance from the engaging cutout portion 108A and the spring member 109A, and similarly, in the second locking mechanism which is included in the second engaging mechanism comprising the end portion 100B of the fixed housing 100 and the end portion 101B of the movable housing 101, the engaging projection 106B is released from the engagement with the engaging cutout portion 108B to be at a small distance from the engaging cutout portion 108B and the spring member 109B.

Thereby, the movable housing 101 is supported only by the conductive contacts 102 arranged along the predetermined direction with the respective first portions connected with the circuit terminals on the circuit board 95, so that the movable housing 101 accompanied with the counterpart electrical connector is able to move freely to the fixed housing 100 in the predetermined range and takes the second posture with which the insertion direction of the counterpart electrical connector to the connecting hollows 103A and 103B is in substantially parallel with the circuit board 95. In such a condition, the spring members 109A and 109B block up the slits 105A and 105B, respectively, and therefore the engaging projections 106A and 106B are prevented from getting away to the outside of the fixed housing 100 through the slits 105A and 105B, respectively.

As a result, vibrations and shocks acting on an apparatus or device, such as the hard disc drive, on which the counterpart electrical connector is provided are absorbed by the movable housing 101 so that the apparatus or device on which the counterpart electrical connector is provided is protected against the vibrations and shocks acting thereon.

Figure 37:
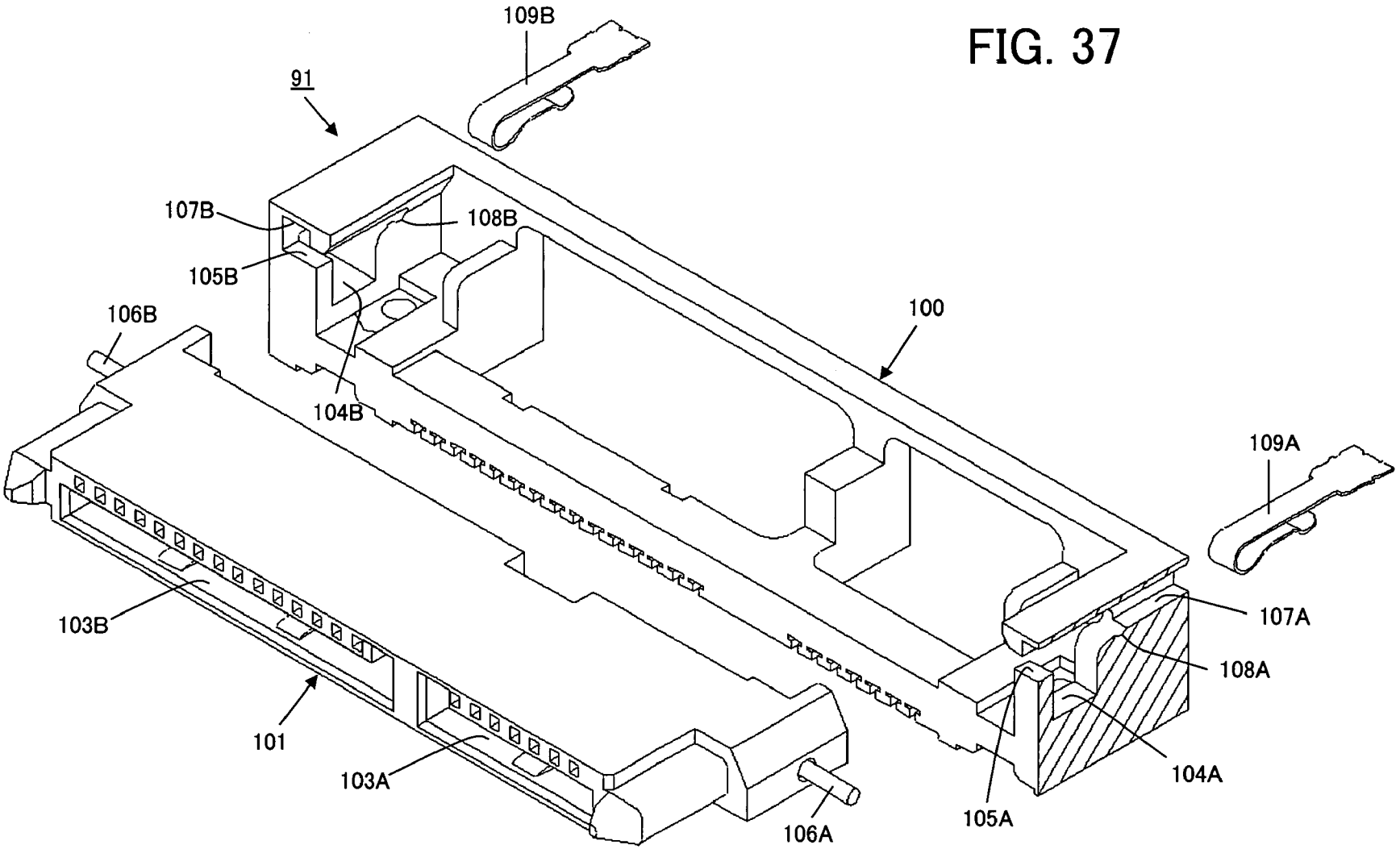
FIG. 37 is a schematic exploded perspective view showing the embodiment shown in FIG. 29, a part of which is cut out.

FIG. 37 shows the electrical connector 91 put in an exploded state in which the electrical connector 91 is divided into the fixed housing 100 on which the guiding holes 104A and 104B having the engaging cutout portions 108A and 108B, respectively, the slits 105A and 105B and the through holes 107A and 107B are provided, the movable housing 101 on which the engaging projections 106A and 106B and the connecting hollows 103A and 103B are provided, and the spring members 109A and 109B. The conductive contacts 102 for coupling the movable housing 101 with the fixed housing 100 are omitted on FIG. 37. Further, although the circuit board 95 is omitted on FIG. 37, the fixed housing 100 is attached to the circuit board 95.

Figure 38:
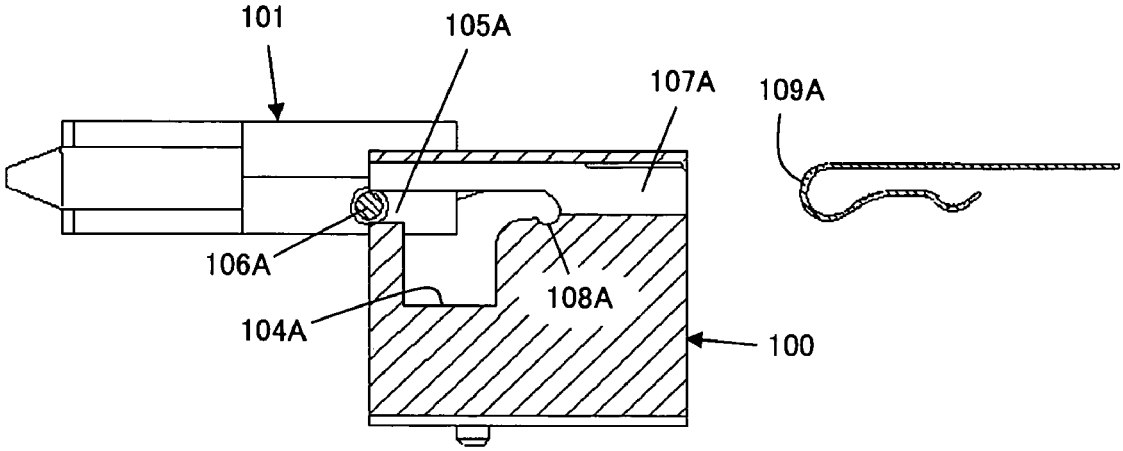
FIGS. 38, 39 and 40 are schematic partially sectional side views used for explaining assembling steps of the embodiment shown in FIG. 29.

When the electrical connector 91 thus put in the exploded state is assembled, first, the movable housing 101 is caused to take the second posture with which the insertion direction of the counterpart electrical connector to the connecting hollows 103A and 103B is in substantially parallel with the circuit board 95. Then, as shown in FIG. 38, the engaging projection 106A provided on the movable housing 101 is moved to the guiding hole 104A provided on the fixed housing 100 through the slit 105A provided on the fixed housing 100 from the outside of the fixed housing 100 and similarly the engaging projection 106B (not shown in FIG. 38) provided on the movable housing 101 is also moved to the guiding hole 104B provided on the fixed housing 100 through the slit 105B provided on the fixed housing 100 from the outside of the fixed housing 100.

Figure 39:
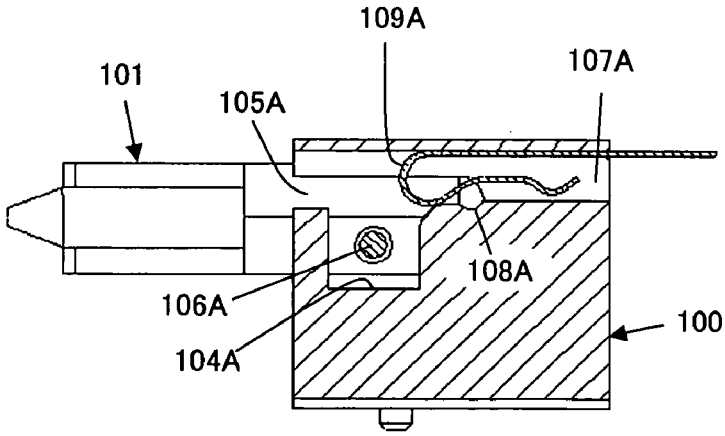

The engaging projection 106A moved through the slit 105A to the guiding hole 104A is held in the guiding hole 104A, as shown in FIG. 39, and the engaging projection 106B moved through the slit 105B to the guiding hole 104B is also held in the guiding hole 104B, as shown in FIG. 39. Thereby, the movable housing 101 is connected to be movable with the fixed housing 100.

After that, the spring member 109A is inserted into the through hole 107A provided on the fixed housing 100 through an opening of the through hole 107A formed on an rear end portion of the fixed housing 100 opposite to a front end portion of the fixed housing 100 on which the slit 105A is provided, as shown in FIG. 39. The spring member 109B is also inserted into the through hole 107B provided on the fixed housing 100 through an opening of the through hole 107B formed on the rear end portion of the fixed housing 100 opposite to the front end portion of the fixed housing 100 on which the slit 105B is provided.

Figure 40:
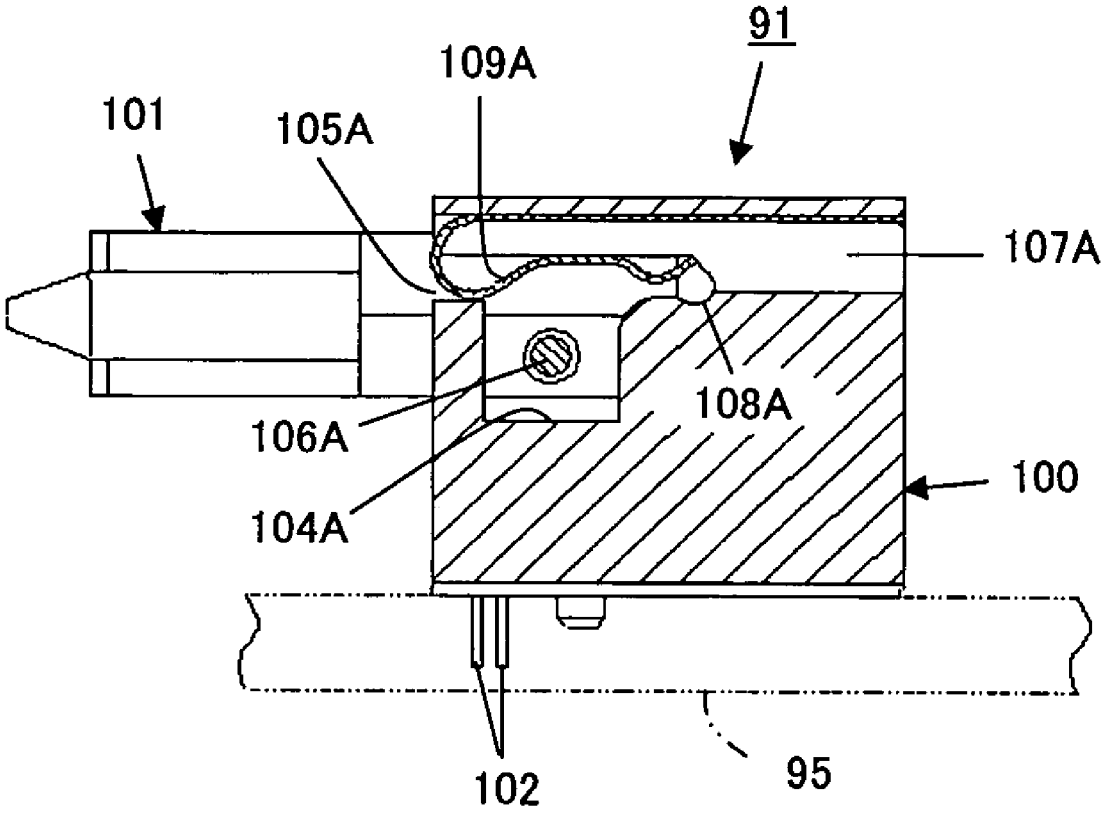

The spring member 109A is so positioned in the through hole 107A as to block up the slit 105A, as shown in FIG. 40. At that time, one end portion of the spring member 109A is put in the opening of the through hole 107A on the rear end of the fixed housing 100 and the other end portion of the spring member 109A which is folded back at the slit 105A faces to the engaging cutout portion 108A of the guiding hole 104A, as shown in FIG. 40. The spring member 109B is also so positioned in the through hole 107B as to block up the slit 105B. At that time, one end portion of the spring member 109B is put in the opening of the through hole 107B on the rear end of the fixed housing 100 and the other end portion of the spring member 109B which is folded back at the slit 105B faces to the engaging cutout portion 108B of the guiding hole 104B.

Then, the conductive contacts 102 are mounted on the fixed housing 100 and the movable housing 101 for coupling the movable housing 101 with the conductive contacts 102. The first end portion of each of the conductive contacts 102 extends from the fixed housing 100 to the circuit board 95 to be electrically connected with the circuit terminal on the circuit board 95, as shown in FIG. 40.

With the steps mentioned above, the assembly of the electrical connector 91 is completed. In the electrical connector 91 thus assembled, the movable housing 101 is put selectively in the locked state in which the movable housing 101 is temporarily fixed to the fixed housing 100 and takes the first posture with which the inserting direction of the counterpart electrical connector to the connecting hollows 103A and 103B is set to be, for example, substantially perpendicular to the circuit board 95 and in the floating state in which the movable housing 101 is able to move freely to the fixed housing 100 in the predetermined range and takes the second posture with which the inserting direction of the counterpart electrical connector to the connecting hollows 103A and 103B is in substantially parallel with the circuit board 95.

As described above, the electrical connector 91 which comprises the fixed housing 100 on which the guiding holes 104A and 104B having the engaging cutout portions 108A and 108B, respectively, the slits 105A and 105B and the through holes 107A and 107B are provided, the movable housing 101 on which the engaging projections 106A and 106B and the connecting hollows 103A and 103B are provided, the spring members 109A and 109B, and the conductive contacts 102, can be assembled with relatively simple structure with easy assembling operations in production facilities. In the case of the electrical connector 91 also, movable ranges in the X, Y and Z directions of the movable housing 101 which is put in the floating state are determined in the same manner as the case of the electrical connector 11, 41 or 71 explained above.

Although a couple of connecting hollows 23A and 23B, 53A and 53B, 83A and 83B or 103A and 103B are provided on the movable housing 21, 51, 81 or 101 in each of the embodiments described above, it should be understood that a single connecting hollow or more than tow connecting hollows can be provided on the movable housing of the electrical connector according to the present invention.

What is claimed is:

1. An electrical connector comprising:

a fixed housing attached to a circuit board, a movable housing provided with a connecting hollow in which a counterpart electrical connector is inserted, a plurality of conductive contacts which are arranged along a predetermined direction for coupling the movable housing with the fixed housing and each of which has a first portion connected with a circuit terminal on the circuit board to which the fixed housing is attached and a second portion positioned in the connecting follow for coming into press-contact with a connecting terminal provided on the counterpart electrical connector inserted in the connecting hollow, and an engaging mechanism including parts of the fixed and movable housings and operative to put the movable housing selectively in a first state in which the movable housing is temporarily fixed to the fixed housing and takes a first posture with which an inserting direction of the counterpart electrical connector to the connecting hollow is angled to the circuit board to which the fixed housing is attached and in a second state in which the movable housing is able to move freely to the fixed housing in a predetermined range and takes a second posture with which the inserting direction of the counterpart electrical connector to the connecting hollow is in substantially parallel with the circuit board to which the fixed housing is attached.

2. An electrical connector according to claim 1, wherein each of said conductive contacts is made of conductive resilient material for forcing the movable housing to keep away from the fixed housing.

3. An electrical connector according to claim 1, wherein said engaging mechanism is operative to allow the movable housing to rotate to the fixed housing so that the inserting direction of the counterpart electrical connector to the connecting hollow varies in its angle to the circuit board to which the fixed housing is attached.

4. An electrical connector according to claim 1, wherein said engaging mechanism comprises an end portion of the fixed housing in the direction along which the conductive contacts are arranged and an end portion of the movable housing corresponding to said end portion of the fixed housing and includes a locking mechanism for putting the movable housing in said first state.

5. An electrical connector according to claim 4, wherein said locking mechanism comprises an engaging cutout portion provided on said end portion of the fixed housing and an engaging projection provided on said end portion of the movable housing for engaging with said engaging cutout portion.

6. An electrical connector according to claim 5, wherein said engaging projection is operative to move away from said circuit board for engaging with the engaging cutout portion.

7. An electrical connector according to claim 5, wherein said locking mechanism further comprises a spring member operative to keep the engaging projection in its engagement with the engaging cutout portion.

8. An electrical connector according to claim 4, wherein said locking mechanism comprises a guiding groove and an engaging groove each provided on said end portion of the fixed housing and a contacting portion for coming into contact with said guiding groove to be guided by said guiding groove and a board-shaped engaging portion for engaging with said engaging groove to be positioned by said engaging groove, each of said contacting portion and said board-shaped engaging portion being provided on said end portion of the movable housing.

9. An electrical connector according to claim 8, wherein said guiding groove is formed into a V-shaped groove.

10. An electrical connector according to claim 4, wherein said locking mechanism comprises an engaging cutout portion and a contacting portion each provided on said end portion of the fixed housing and an engaging projection provided on said end portion of the movable housing for engaging with said engaging cutout portion and a part of said end portion of the movable housing for coming into contact with said contacting portion.

11. An electrical connector according to claim 10, wherein said engaging projection is operative to move toward said circuit board for engaging with the engaging cutout portion.

12. An electrical connector according to claim 4, wherein said engaging mechanism comprises a guiding hole having an engaging cutout portion and a slit for connecting said guiding hole with the outside of the fixed housing, each of said guiding hole and said slit being provided on said end portion of the fixed housing, and an engaging projection provided on said end portion of the movable housing and operative to move into said guiding hole through said slit from the outside of the fixed housing for engaging with said engaging cutout portion, and said locking mechanism comprises said engaging cutout portion and said engaging projection.

13. An electrical connector according to claim 12, wherein said locking mechanism further comprises a spring member for engaging with said slit and keeping said engaging projection in its engagement with said engaging cutout portion.

14. An electrical connector according to claim 13, wherein said spring member is so positioned as to block up said slit.

15. An electrical connector according to claim 13, wherein said engaging mechanism further comprising a through hole provided on said end portion of the fixed housing for leading to both of said guiding hole and said slit and containing said spring member.

16. An electrical connector according to claim 12, wherein said locking mechanism is operative to put said movable housing in the first state in which said movable housing is temporarily fixed to said fixed housing and takes the first posture with which the inserting direction of the counterpart electrical connector to the connecting hollow provided on said movable housing is set to be substantially perpendicular to said circuit board.

* * * * *